US010072601B2

(12) United States Patent
Hermann et al.

(10) Patent No.: US 10,072,601 B2
(45) Date of Patent: Sep. 11, 2018

(54) METHOD FOR OPERATING A COMMON RAIL INJECTION ARRANGEMENT FOR AN INTERNAL COMBUSTION ENGINE HAVING A STOP-START SYSTEM

(71) Applicant: Ford Global Technologies, LLC, Dearborn, MI (US)

(72) Inventors: Dietmar Hermann, Roetgen (DE); Uwe Reuter, Roetgen (DE); David van Bebber, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 27 days.

(21) Appl. No.: 15/053,766

(22) Filed: Feb. 25, 2016

(65) Prior Publication Data

US 2016/0245220 A1 Aug. 25, 2016

(30) Foreign Application Priority Data

Feb. 25, 2015 (DE) ..... 10 2015 203 348

(51) Int. Cl.
*F02D 41/38* (2006.01)
*F02D 41/06* (2006.01)
(Continued)

(52) U.S. Cl.
CPC ..... *F02D 41/3863* (2013.01); *F02D 41/062* (2013.01); *F02D 41/26* (2013.01);
(Continued)

(58) Field of Classification Search
CPC .. F02D 41/3863; F02D 41/26; F02D 41/3818; F02D 41/3827; F02D 41/062;
(Continued)

(56) References Cited

U.S. PATENT DOCUMENTS 6,659,085 B2 * 12/2003 Kojima ..... F02D 41/009 123/179.17
7,171,944 B1 * 2/2007 Oono ..... F02M 37/04 123/357

(Continued)

FOREIGN PATENT DOCUMENTS

DE 102013225418 A1 6/2015
JP 2011058369 A 3/2011

*Primary Examiner* — Joseph Dallo
*Assistant Examiner* — Kurt Liethen
(74) *Attorney, Agent, or Firm* — Julia Voutyras; McCoy Russell LLP

(57) ABSTRACT

Methods and system are provided for operating a fuel system of a stop-start engine system. In one example a method may comprise powering off a lift pump and maintaining a volume control valve in a closed position during an engine stop to maintain a fuel pressure within a fuel rail and one or more fuel injectors. The method may further comprise, in response to determining an engine start is desired, powering on the lift pump, initiating cylinder combustion, and operating a higher pressure pump (HPP) in an unpressurized mode when a fuel pressure upstream of the HPP is less than a threshold and switching to operating the HPP in a pressurized mode when the fuel pressure upstream of the HPP reaches the threshold.

20 Claims, 8 Drawing Sheets

(51) Int. Cl.

| | |
|---|---|
| ***F02D 41/26*** | (2006.01) |
| *F02D 41/04* | (2006.01) |
| *F02N 11/08* | (2006.01) |
| *F02M 55/02* | (2006.01) |

(52) U.S. Cl.
CPC ..... *F02D 41/3818* (2013.01); *F02D 41/3827* (2013.01); *F02D 41/3845* (2013.01); *F02D 41/3854* (2013.01); *F02D 41/042* (2013.01); *F02M 55/025* (2013.01); *F02N 11/0814* (2013.01)

(58) Field of Classification Search
CPC ..... F02D 41/3845; F02D 41/3854; F02D 41/042; F02M 55/025; F02N 11/0814
See application file for complete search history.

(56) References Cited

U.S. PATENT DOCUMENTS

| | | | | |
|---|---|---|---|---|
| 7,832,375 | B2 * | 11/2010 | Dusa | F02D 41/06 123/179.16 |
| 8,793,059 | B2 * | 7/2014 | Albrecht | F02D 41/3854 123/447 |
| 2006/0207567 | A1 * | 9/2006 | Yamaguchi | B60W 10/06 123/431 |
| 2010/0089366 | A1 * | 4/2010 | Tanaka | F02D 41/401 123/447 |
| 2012/0080010 | A1 * | 4/2012 | Nistler | F02D 41/3863 123/456 |
| 2013/0206111 | A1 * | 8/2013 | Riepl | F02D 41/3845 123/478 |
| 2016/0138514 | A1 * | 5/2016 | Carboni | F02D 41/123 123/459 |

* cited by examiner

METHOD FOR OPERATING A COMMON RAIL INJECTION ARRANGEMENT FOR AN INTERNAL COMBUSTION ENGINE HAVING A STOP-START SYSTEM

CROSS REFERENCE TO RELATED APPLICATION

The present application claims priority to German Patent Application No. 102015203348.1, filed on Feb. 25, 2015, the entire contents of which are hereby incorporated by reference for all purposes.

FIELD

The present description relates generally to methods and systems for operating a common rail injection arrangement for an internal combustion engine having a stop-start system.

BACKGROUND/SUMMARY

Internal combustion engines are used to convert the energy contained in a fuel into volume change work. For this purpose, the internal combustion engine has at least one combustion chamber, in which the fuel is burnt. The volume expansion that occurs during combustion is then converted into a rotary motion, which can be used for propulsion of an on-road vehicle.

In order to obtain a combustible mixture for the combustion process, the fuel is mixed with ambient air, in particular with the oxygen ($O_2$) contained therein. In direct injection (DI) engines, fuel is injected directly engine cylinders, and mixing of fuel and oxygen takes place almost exclusively within the combustion chambers.

Internal combustion engines including DI fuel systems may be divided into applied-ignition engines and self-ignition engines. In this context, spark-ignition engines are applied-ignition engines since the mixture situated in the combustion chamber is initially compressed and then ignited actively by extraneous means, for example by a spark plug. In contrast, diesel engines are referred to as self-ignition engines. In the case of these engines, compression centers on the air supply to the combustion chamber, which undergoes a rapid rise in temperature as a result. The resulting temperature level is sufficient to ignite the diesel fuel which is then to be injected into the combustion chamber filled in this way with heated air.

In DI fuel systems, engine fuel may be pumped out of a fuel tank by a lift pump. The lift pump propels fuel towards a fuel rail before being injected by fuel injectors. DI systems generally have a single manifold (common fuel rail) for each row of cylinders. In the description herein, said manifold can be designed as an elongate or ball-type rail. Common rail injection arrangements are usually used with internal combustion engines operated with diesel fuel. Nonetheless, they can also be used in an appropriate configuration for spark-ignition engines operated with gasoline fuel.

Further, DI fuel systems typically include a high-pressure pump upstream of the fuel rail to further pressurize the fuel pumped out of the fuel tank by the lift pump before the fuel reaches the fuel rail. Thus, a substantially continuous buildup of a fuel pressure may be produced by the high-pressure pump within the fuel rail. Individual injection nozzles are fluidically connected to the fuel rail to deliver pressurized fuel from the fuel rail to each combustion chamber. These nozzles may be electronically controlled to open and close at a desired rate over a required period of time to deliver a desired fuel volume. In this way, some of the fuel available under pressure at the individual injection nozzles is discharged into the respective combustion chambers as the internal combustion engine runs.

The high-pressure pump is generally connected in a torque-transmitting manner to the internal combustion engine. Thus, the operating state (e.g., speed) of the high-pressure pump, and therefore the amount of pressure added to the fuel being supplied to the fuel rail, depends directly on the operating state of the internal combustion engine. In other words, the high-pressure pump may stop operating when the internal combustion engine is switched off in a stop phase. Particularly in conjunction with stop-start systems for internal combustion engines, which are provided to lower fuel consumption, there are increased requirements on the performance of common rail injection arrangements. During the stop phase in stop-start systems when the high-pressure pump is off, the pressure in the fuel rail can fall. In some examples, the pressure in the fuel rail can drop below a minimum pressure required for injection during the stop phase. To start the internal combustion engine, it is therefore necessary to build up again and/or maintain the required fuel pressure within the common rail injection arrangement by means of the high-pressure pump. However, in order to supply the minimum pressure required for injection to the fuel rail, fuel supplied to the pump elements of the high-pressure pump may need to be initially pressurized.

Another reason for said initial pressure lies in the configuration of the high-pressure pumps used for common rail injection arrangements, these pumps being lubricated by means of the fuel. Accordingly, high-pressure may require a virtually uninterrupted supply of fuel to their bearings. This applies especially to operating states in which the pump shaft is rotating under load. For this purpose, a lift pump or pre-supply pump, is included to pump fuel from the fuel tank to the high-pressure pump.

Pre-supply pumps are conventionally electric. Electric pre-supply pumps can be switched on and off in a flexible manner when operating conditions allow, thus reducing the energy required to drive the pre-supply pump and hence increasing fuel efficiency and lowering noise levels.

The additional use of electric pre-supply pumps allows uninterrupted lubrication of the high-pressure pump with fuel and enables the internal combustion engine to be put into operation more quickly when exiting from a stop phase.

However, the inventors herein have recognized potential issues with such systems. As one example, the pre-supply pump may continue to run during a stop phase in a stop-start system, thereby increasing energy consumption and reducing fuel efficiency during the stop phase. Additionally, operation of the pre-supply pump may be perceptible and objectionable to a vehicle occupant via vibration and/or noise, especially when the internal combustion engine is switched off.

As one example, the issues described above may be addressed by a method for operating a common rail injection arrangement, which is provided for an internal combustion engine having a stop-start system and which comprises a pre-supply pump, connected to a high-pressure pump in a manner which allows fluid transfer, and a manifold, connected to the high-pressure pump in a manner which allows fluid transfer, as well as at least one injection nozzle, connected to the manifold in a manner which allows fluid transfer, wherein the pre-supply pump is kept active when the internal combustion engine is in operation, may comprise: initiating a stop phase by putting the running internal combustion engine and the high-pressure pump out of operation, wherein the pre-supply pump may be switched to the inactive state, initiating a starting phase for the out-of-operation internal combustion engine, wherein the high-pressure pump may be operated at least temporarily in an unpressurized state before or during the starting phase of the internal combustion engine, while the pre-supply pump is switched to the active state and delivers fuel to the high-pressure pump and builds up pre-supply pressure, operating the high-pressure pump to maintain and/or increase the pressure within the common rail injection arrangement, when a pre-supply pressure increases above a threshold, and starting the internal combustion engine by cranking the engine and injecting fuel into a combustion chamber of the internal combustion engine with the aid of the pressure provided within the common rail injection arrangement.

In another representation a system for a common rail injection arrangement of a stop-start engine may comprise: a high-pressure fuel pump, a pre-supply pump, connected to a high-pressure fuel pump in a manner which allows fluid transfer, wherein the pre-supply pump is kept active when the internal combustion engine is in operation, a manifold, connected to the high-pressure pump in a manner which allows fluid transfer, at least one injection nozzle, connected to the manifold in a manner which allows fluid transfer, and a controller with computer readable instructions stored in non-transitory memory for: initiating a stop phase by putting the running internal combustion engine and the high-pressure pump out of operation, wherein the pre-supply pump is also switched to the inactive state, maintaining, within the common rail injection arrangement, a pressure built up by the high-pressure pump during the operation of the internal combustion engine, wherein the pre-supply pump is simultaneously kept inactive, initiating a starting phase for the out-of-operation internal combustion engine, wherein the pre-supply pump is switched to an active state, starting of the internal combustion engine by cranking the latter and at least partial injection of fuel into a combustion chamber of the internal combustion engine with the aid of the pressure maintained within the common rail injection arrangement, wherein the high-pressure pump is operated at least temporarily in an unpressurized state during the starting, and switching the high-pressure pump into a pressurized state to maintain and/or increase the pressure within the common rail injection arrangement, in response to a pre-supply pressure increasing above a threshold to continue supplying the running internal combustion engine with fuel.

In yet a further representation, a method for a stop-start engine may comprise during an engine stop: powering off a lift pump, and in response to determining an engine start is desired: powering on the lift pump, initiating cylinder combustion, and operating a higher pressure pump (HPP) in an unpressurized mode, and switching the HPP to a pressurized mode in response to fuel pressure upstream of the HPP reaching a threshold. In the above method, a volume control valve may be positioned between the HPP and the lift pump, and may be adjusted to a closed position in the unpressurized mode, where in the closed position of the volume control valve, substantially no fuel flows flow there-through. In some examples, the operating the HPP in the unpressurized mode may comprise maintaining the volume control valve in the closed position during both intake and compression strokes of the HPP. Further, the switching the HPP to the pressurized mode may comprise opening the volume control valve to supply fuel to the higher pressure pump. In other examples, an inlet valve may be positioned between the lift pump and a single pressure chamber of the lift pump for regulating fuel flow there-between. In the unpressurized mode, the inlet valve may be adjusted to an open position to allow fuel between the lift pump and the higher pressure pump to increase a pressure of fuel supplied to the higher pressure pump.

In this way, fuel pressure in a fuel rail and fuel injectors may be maintained during an engine stop and fuel in a higher pressure pump may be expelled from the pump by closing a valve positioned between a lift pump and a higher pressure pump. As such, fuel injection delays during a subsequent engine start may be reduced, and fuel may more quickly be injected to facilitate an engine start after an engine stop. Further, by powering on the lift pump and operating the higher pressure pump in an unpressurized mode prior to and/or during the engine start, a pressure of fuel supplied to the higher pressure pump during the engine start may be increased. Operating the higher pressure pump in the unpressurized mode during the engine start may reduce strain on the higher pressure pump, and increase longevity of the pump. Additionally, by powering on the lift pump and operating the higher pressure pump in an unpressurized mode prior to and/or during the engine start, fuel pressure may be added to the fuel rail and fuel injectors more quickly during an engine start, further reducing any delays in fuel delivery to one or more engine cylinders. Thus, the fuel system may be more responsive and fuel delivery may be more immediate. Further, by powering off the lift pump during an engine stop, noise and energy consumption may be reduced.

In the description herein, a pre-supply pump may also be referred to as a lift pump, lower pressure pump (LPP), and low-pressure pump.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
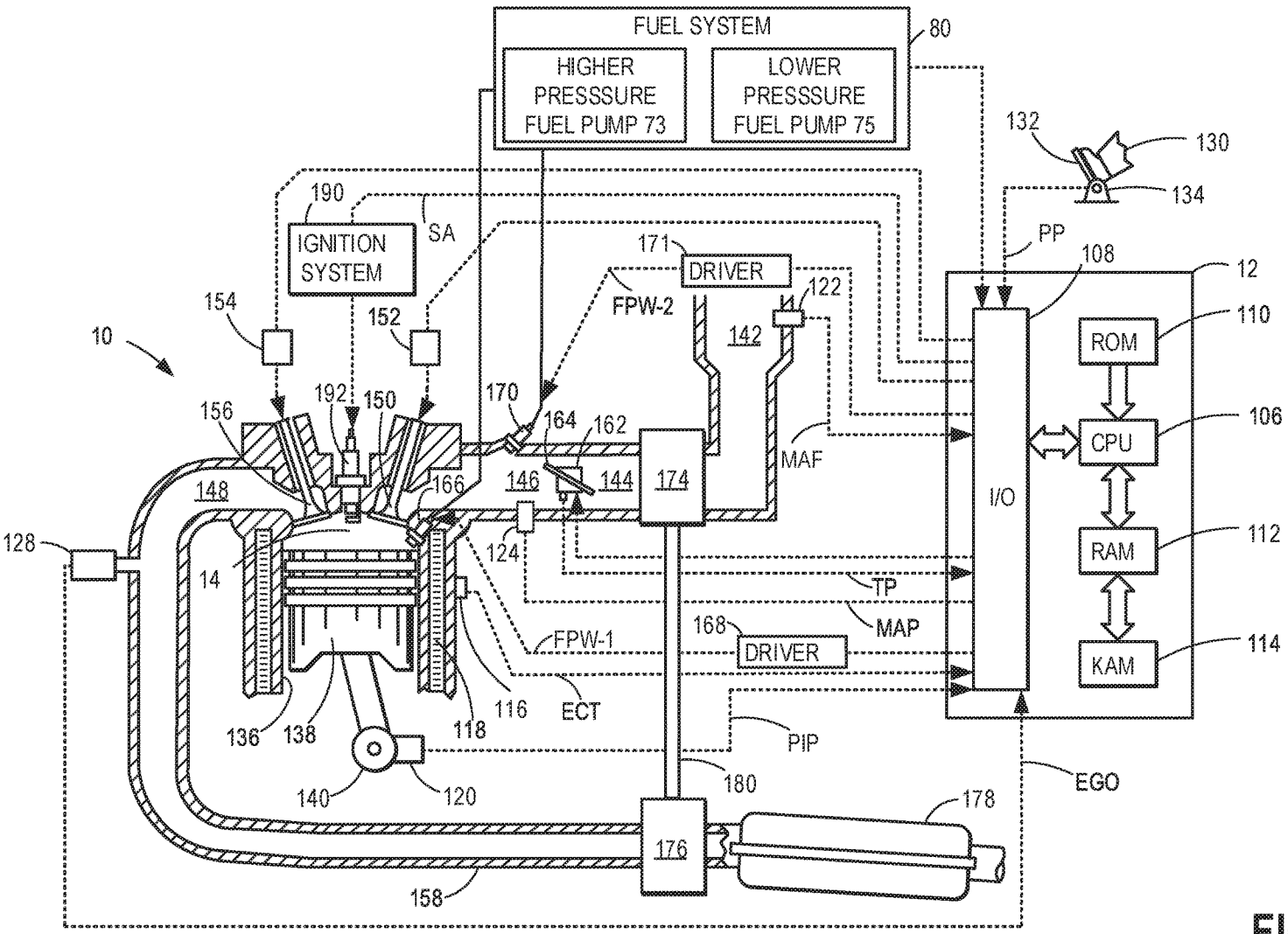
FIG. 1 shows a schematic diagram of an example engine system including a fuel system that may comprise direct injection.

The following description relates to systems and methods for operating a lift pump in a stop-start engine system, such as the engine system shown in FIG. 1. The lift pump may be included in a direct injection fuel system such as the example fuel system of FIG. 2. Fuel in the fuel tank is first pressurized by the lift pump, and is pumped out of the fuel tank to a high-pressure fuel pump. Several embodiments of a high-pressure fuel pump are shown in FIGS. 3, 5, and 7. The high-pressure fuel pump further pressurizes the fuel en route to a fuel rail where the fuel is then injected to one or more combustion chambers via individual injectors. As explained in the example methods of FIGS. 4, 6, and 8 the operation of the lift pump and high-pressure pump may be adjusted during an engine stop phase and engine start phase to reduce energy consumption and increase fuel delivery responsiveness of the fuel system.

FIG. 1 depicts an example of a combustion chamber or cylinder of internal combustion engine 10, which may be included in an on-road vehicle. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (herein also termed combustion chamber 14) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel (not shown) to enable a starting operation of engine 10.

Cylinder 14 can receive intake air via a series of intake air passages 142, 144, and 146. Intake air passages 142, 144, and 146 can communicate with other cylinders of engine 10 in addition to cylinder 14. In some examples, one or more of the intake air passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 158. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine.

A throttle 162 including a throttle plate 164 may be arranged between intake air passages 144 and 146 of the engine for varying the flow rate and/or pressure of intake air provided to the engine cylinders. As shown in FIG. 1, throttle 162 may be positioned downstream of compressor 174, or alternatively may be provided upstream of compressor 174.

Exhaust manifold 148 can receive exhaust gases from other cylinders of engine 10 in addition to cylinder 14. Exhaust gas sensor 128 is shown coupled to exhaust passage 158 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom dead center position or top dead center position. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including first fuel injector 166. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into cylinder 14. Thus, first fuel injector 166, may also be referred to herein as DI fuel injector 166. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 80 via a higher pressure fuel pump 73, and a fuel rail. Further, the fuel tank may have a pressure transducer providing a signal to controller 12.

Additionally or alternatively, engine 10 may include second fuel injector 170. Fuel injector 166 and 170 may be configured to deliver fuel received from fuel system 80. Specifically, fuel may be delivered to fuel injector 170 from a fuel tank of fuel system 80 via a lower pressure fuel pump 75, and a fuel rail. As elaborated later in the detailed description, fuel system 80 may include one or more fuel tanks, fuel pumps, and fuel rails.

Fuel system 80 may include one fuel tank or multiple fuel tanks. In embodiments where fuel system 80 includes multiple fuel tanks, the fuel tanks may hold fuel with the same fuel qualities or may hold fuel with different fuel qualities, such as different fuel compositions. These differences may include different alcohol content, different octane, different heat of vaporizations, different fuel blends, and/or combinations thereof etc. In one example, fuels with different alcohol contents could include gasoline, ethanol, methanol, or alcohol blends such as E85 (which is approximately 85% ethanol and 15% gasoline) or M85 (which is approximately 85% methanol and 15% gasoline). Other alcohol containing fuels could be a mixture of alcohol and water, a mixture of alcohol, water and gasoline etc. In some examples, fuel system 80 may include a fuel tank holding a liquid fuel, such as gasoline, and also include a fuel tank holding a gaseous fuel, such as CNG.

Fuel injectors 166 and 170 may be configured to inject fuel from the same fuel tank, from different fuel tanks, from a plurality of the same fuel tanks, or from an overlapping set of fuel tanks. Fuel system 80 may include the lower pressure fuel pump 75 (such as a lift pump) and a higher pressure fuel pump 73. The lower pressure fuel pump 75 may be a lift pump that pumps fuel out of the one or more fuel tanks towards the one or more injectors 166 and 170. As detailed below with reference to the fuel system of FIG. 2, fuel provided to the first fuel injector 166 may be further pressurized by higher pressure fuel pump 73. Thus, the lower pressure fuel pump 75 may provide fuel directly to one or more of a port injection fuel rail and the higher pressure fuel pump 73, while higher pressure fuel pump 73 may deliver fuel to a direct injection fuel rail.

Fuel injector 170 is shown arranged in intake air passage 146, rather than in cylinder 14, in a configuration that provides what is known as port injection of fuel into the intake port upstream of cylinder 14. Second fuel injector 170 may inject fuel, received from fuel system 80, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for optional fuel injector 170, may be used, as depicted.

In an alternate example, each of fuel injectors 166 and 170 may be configured as direct fuel injectors for injecting fuel directly into cylinder 14. In another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. In still another example, cylinder 14 may be fueled solely by optional fuel injector 170, or solely by port injection (also termed, intake manifold injection). As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among fuel injectors 170 and 166, different effects may be achieved.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor 124 may be used to provide an indication of vacuum, or pressure, in the intake manifold.

The controller 12 receives signals from the various sensors of FIG. 1 and employs the various actuators of FIG. 1 (e.g., throttle 162, fuel injector 166, fuel injector 170, higher pressure fuel pump 73, lower pressure fuel pump 75 etc.) to adjust engine operation based on the received signals and instructions stored on a memory of the controller. Specifically, the controller 12 may adjusting operation of the lower pressure fuel pump 75 based on a desired fuel injection amount and/or a pressure of a fuel rail as described in greater detail below with reference to FIG. 2.

The controller 12 may include instructions stored in non-transitory memory for implementing an engine start/stop system. For example, the controller 12 may determine a shutdown condition for the engine based on engine operating conditions. For example, the controller 12 may determine a shutdown condition when the vehicle is stopped at a stop light. As such the engine 10 may be stopped in response to the shutdown condition. Further, the controller 12 may determine when a restart condition for the engine is desired. For example, the controller 12 may determine that an engine start is desired in response to a driver request for acceleration. During the engine start, the transmission may be adjusted and the engine 10 may then be started via the starter motor.

Further the controller 12 may include instructions stored in non-transitory memory for executing the methods and routines described herein, such as the method described below with reference to FIG. 3. Specifically, the controller 12 may include instructions for adjusting operation of one or more of the lower pressure fuel pump 75, higher pressure fuel pump 73, and for adjusting a position of a valve positioned between the two pumps 73 and 75 during engine start and stop conditions. As explained in greater detail below with reference to FIG. 3, the valve positioned between the two pumps 73 and 75 may be closed during and engine stop, and the two pumps 73 and 75 may be powered off. When transitioning from an engine stop to an engine start, the lower pressure pump 75 may be turned on, and the valve positioned between the two pumps 73 and 75 may be held open for a duration. As such, the higher pressure pump 75 may be operated in an unpressurized mode when initiating an engine start.

Figure 2:
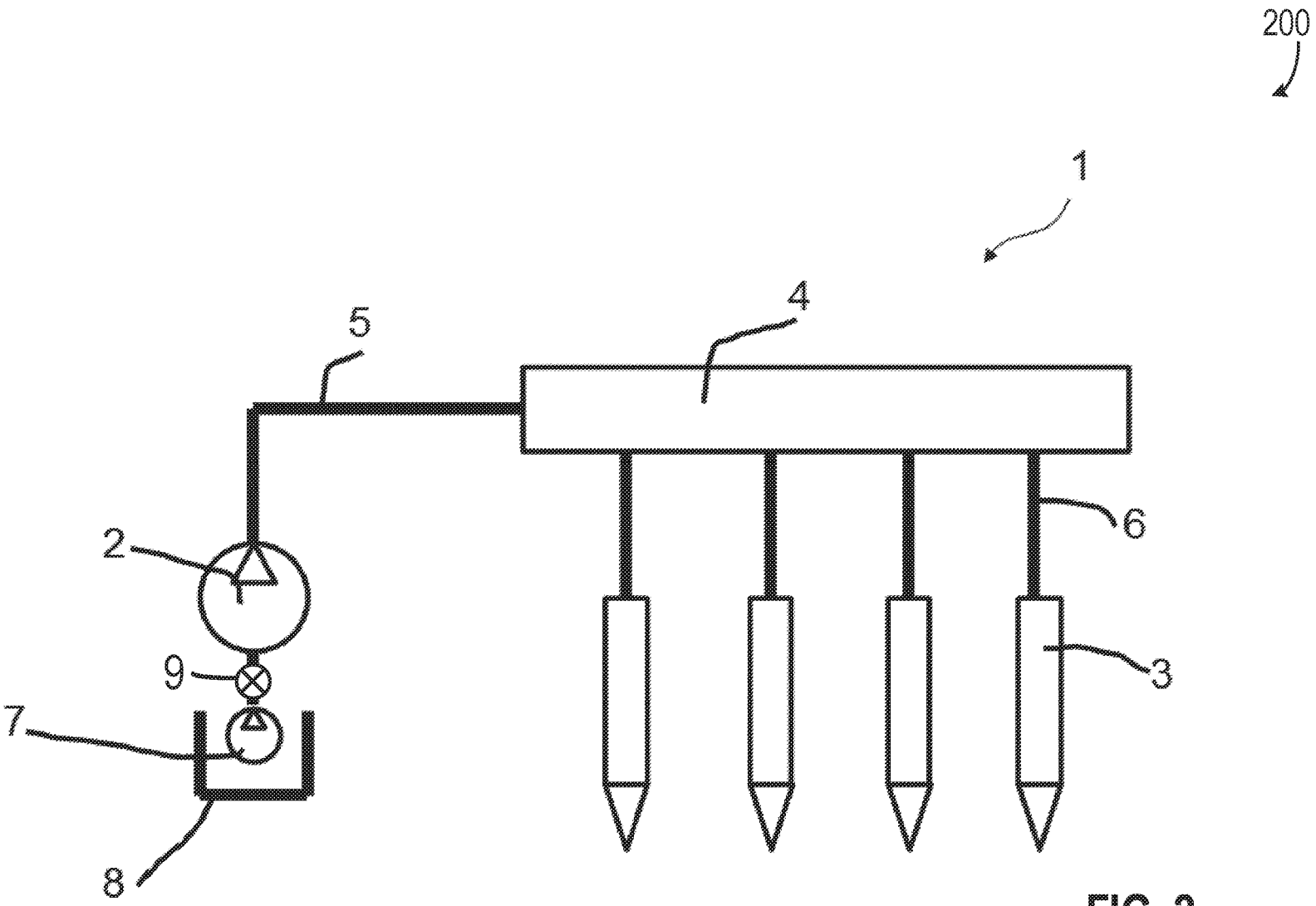
FIG. 2 shows a block diagram of an example embodiment of a fuel system that may be included in the engine system of FIG. 1.
Figure 3:
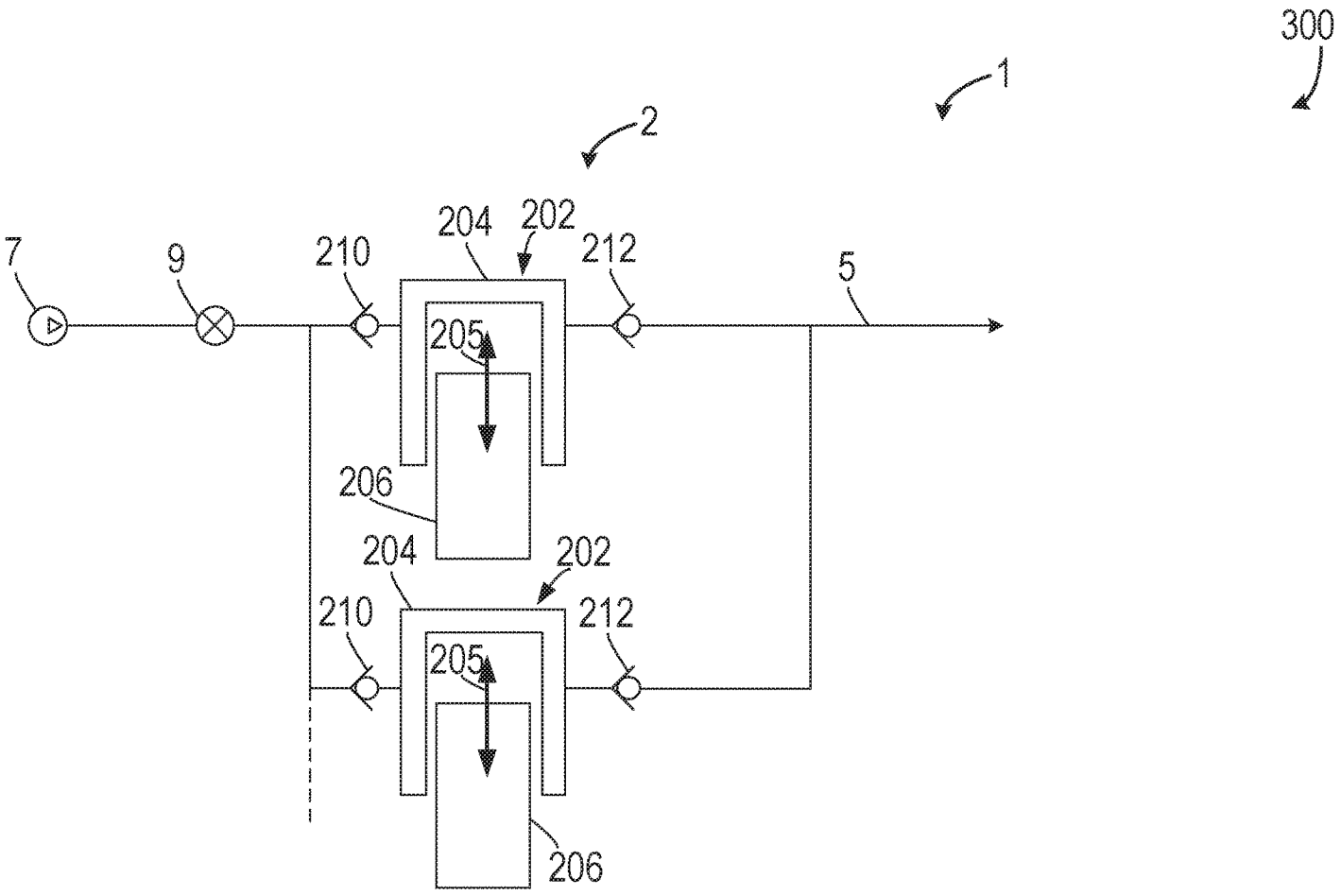
FIG. 3 shows a schematic of a first example of a portion of the fuel system of FIG. 2 including a higher pressure pump.

Turning now to FIG. 2, it shows a schematic 200 of an example common rail injection arrangement 1 which may be included in an engine system, such as the engine 10 described above with reference to FIG. 1. Common rail injection arrangement 1 may also be referred to herein as fuel system 1, and may be the same or similar to fuel system 80 described above with reference to FIG. 1. Said common rail injection arrangement 1 is intended for use in conjunction with an internal combustion engine (e.g., engine 10 described above in FIG. 1) which has a stop-start system.

The common rail injection arrangement 1 comprises a high-pressure pump 2 and individual injection nozzles 3, of which four injection nozzles 3 are shown in the present case. The high-pressure pump 2 may be the same or similar to higher pressure pump 75 described above with reference to FIG. 1. There is furthermore a manifold or fuel rail 4, which brings the high-pressure pump 2 into operative relationship with the individual injection nozzles 3. For this purpose, the manifold 4 is connected both to the high-pressure pump 2 and to the injection nozzles 3 in a manner which allows fluid transfer. For this purpose, a delivery line 5 extends between the high-pressure pump 2 and the manifold 4, whereas each individual injection nozzle 3 is connected to the manifold 4 by a respective high-pressure line 6. In the present case, therefore, a total of four high-pressure lines 6 of approximately equal length extend between the respective injection nozzles 3 and the manifold 4.

Also provided is a pre-supply pump 7, which may be the same or similar to lower pressure fuel pump 73 described above with reference to FIG. 1, which in the present case, is arranged within a fuel tank 8. The pre-supply pump 7 is likewise connected to the high-pressure pump 2 in a manner which allows fluid transfer. Pre-supply pump 7 may also be referred to herein as lift pump 7 and lower pressure pump 7.

By means of the pre-supply pump 7, fuel (not shown specifically) can be delivered from the fuel tank 8 to the high-pressure pump 2. Here, said delivery is provided in such a way that it can take place independently of the respective operating state of the high-pressure pump 2 (on/off). This enables a pre-supply pressure to be built up within the high-pressure pump 2 by means of the pre-supply pump 7 before or while the high-pressure pump 2 is starting up from a stop phase of the internal combustion engine.

The high-pressure pump 2 is provided in the conventional manner for delivering fuel supplied from the fuel tank 8 onward into the common rail injection arrangement 1 in the direction of the injection nozzles 3 and, in the process, to apply pressure to it. The high-pressure pump 2 can be designed as a gear pump or preferably as a piston machine, for example. In the latter configuration, the necessary injection pressure is produced by means of at least one piston which, for this purpose, is arranged for linear motion within a cylinder. Specifically, during an intake stroke, the piston may translate in a first direction, increasing the volume of the cylinder. As such, fuel may be introduced to the cylinder during the intake stroke of the piston. During a compression stroke, the piston may translate in a second direction, opposite the first direction, decreasing the volume of the cylinder. As such, fuel introduced to the cylinder during the intake stroke may be pressurized by the piston.

The delivery and pressurization of the fuel, which are thus discontinuous, can be smoothed out by, for example, by increasing the number of pistons and corresponding cylinders, which then operate at least partially in opposition. The high-pressure pump 2 may be driven by the combustion engine. Thus, the high-pressure pump 2 may be coupled to the combustion engine in a torque-transmitting manner, via belts, chains, etc., to transmit energy from the combustion engine to the high-pressure pump 2.

In the example of FIG. 2, injection nozzles 3 are provided in the conventional manner to at least partially inject the available and pressurized fuel into a combustion chamber (e.g., combustion chamber 14 described above in FIG. 1) of the internal combustion engine.

According to the invention, the common rail injection arrangement 1 is advantageously designed in such a way that a fuel pressure previously built up within said arrangement by means of the high-pressure pump 2 can be maintained at least partially for a certain period of time. In this context, "maintained" means that the fuel pressure is substantially constant or decreases very slowly over time. In either case, a sufficient pressure in the common rail injection arrangement 1 may be maintained for starting of the internal combustion engine without the additional need for an active pressure buildup.

For this purpose, the injection nozzles 3, the manifold 4, the delivery line 5 and the high-pressure lines 6 advantageously form a pressure reservoir within the common rail injection arrangement 1, in which reservoir said fuel pressure can be held.

For this purpose, a volume of the common rail injection arrangement 1 included between the high-pressure pump 2, and the injection nozzles 3 may be fluidically sealed when the injection nozzles 3 are closed and a volume control valve 9 is closed. As an example, the common rail injection arrangement 1 may include one or more check valves between the pre-supply pump 7 and the manifold 4 for preventing fuel from flowing out of the manifold 4 towards the pre-supply pump 7. In this way, fuel pressure in the volume of the common rail injection arrangement 1 included between the high-pressure fuel pump 2 and the injection nozzles 3 may be substantially maintained when the injection nozzles are closed, and the pre-supply pump 7 and high-pressure pump 2 are off (e.g., stationary).

In this way the pre-supply pump 7 may be kept inactive during a stop phase of the engine since the high-pressure pump 2 is started in an unpressurized state. By setting the pre-supply pump 7 to an inactive state, energy consumption during the stop phase can be reduced. At the same time, the otherwise present operating noises of the pre-supply pump 7, especially during the stop phase, may be reduced at least to only brief time intervals.

According to a particularly preferred development of the fundamental inventive concept, the common rail injection arrangement 1 can for this purpose be put into an at least partially leak-free state. The at least partially leak-free state enables the pressure within the common rail injection arrangement 1 to be maintained at least temporarily. Said reduced leakage can be accomplished through appropriate embodiments of the individual components of the common rail injection arrangement, for example. As an alternative or as a complementary measure to this, at least one appropriate means can be provided to enable individual segments of the common rail injection arrangement 1 to be closed.

According to an advantageous development, at least one shutoff means can be provided within the common rail injection arrangement. The at least one shutoff means is designed to close the pressure reservoir of the common rail injection arrangement 1 in conjunction with a stop phase of the internal combustion engine. For this purpose, at least one shutoff means for maintaining the pressure within the common rail injection arrangement 1 can be at least partially closed, at least temporarily. As a particularly preferred option, the pressure to be maintained can be held within a pressure reservoir, which, owing to the design, is formed between the high-pressure pump 2 and the injection nozzles 3 within the common rail injection arrangement 1. Thus, the pressure of fuel contained between the high-pressure pump 2 and the injection nozzles 3 may be maintained by closing a valve positioned proximate an inlet of the high-pressure pump 2.

Thus, several measures for avoiding constant leakage are possible for maintaining the pressure in the common rail injection arrangement 1 during a stop phase of the internal combustion engine. As such, the pressure in the common rail injection arrangement 1 may be maintained above a threshold pressure sufficient for injection by the injection nozzles 3 during the stop phase of the engine. Therefore, the high-pressure pump can advantageously be accelerated in an unpressurized manner without delaying the first possible injection into the combustion chambers.

Simulations carried out in this respect have made it possible to observe that the pressure drop in typical common rail injection arrangements is significantly less than 100 bar at an illustrative fuel pressure of 1000 bar and an average fuel injection volume of, for example, 35 $mm^3$, if the fuel pressure is not additionally lowered by further sources of consumption, e.g. leakage.

In one example the shutoff means for maintain pressure in the common rail injection arrangement 1 may comprise a volume control valve 9. The volume control valve 9 may be positioned upstream of the high-pressure pump 2, between the high-pressure pump 2 and the pre-supply pump 7. As such, volume control valve 9 fuel supply valve 9. Further, the volume control valve 9 is connected to the high-pressure pump 2 in a manner which allows fluid transfer. The volume control valve 9 can be used in a customary manner to regulate the volume of fuel which reaches the high-pressure pump 2, in particular the pressure chamber (cylinder) thereof.

As described in greater detail below with reference to FIGS. 5 and 7, one or more inlet valves may be positioned between the volume control valve (VCV) 9 and individual pressure chambers of the high-pressure pump 2. Thus, in some examples where the high-pressure pump 2 includes more than one pressure chamber, more than one inlet may be included, where each inlet valve communicates with a single pressure chamber. Thus, separate inlet valves may regulate an amount of fuel flowing into each of the pressure chambers of the high-pressure pump. Said volume control valve 9 may be closed in conjunction with a stop phase of the internal combustion engine. Here, "in conjunction with a stop phase" means that the volume control valve 9 can be closed before and/or during the stop phase.

It is thereby possible to enable the pressure chamber of the high-pressure pump 2 not to be filled with pressurized fuel during the stop phase by closing the volume control valve 9. In the closed position of the volume control valve 9, substantially no fuel flows there-through. As such, no fuel flows to the high-pressure pump 2 from the pre-supply pump 7 when the volume control valve 9 is adjusted to a fully closed position. With the volume control valve 9 closed, the pump shaft of the high-pressure pump 2 may be started up at substantially no pressure. In this context, lubrication of the high-pressure pump 2 with fuel, which would otherwise be required continuously, may be reduced since wear on the pump bearings is reduced during unpressurized start.

In the context of the invention, the idea is that the volume control valve 9 (intake throttle volume control) should for this purpose be arranged upstream of the high-pressure pump 2. Thus, the volume control valve 9 is closed when the stop phase is initiated, wherein the existing fuel is expelled into the common rail injection arrangement 1 and the high-pressure pump 2 is not refilled. In this way, the high-pressure pump 2 can start up substantially free from pressure until the volume control valve 9 is reopened and refilling of the relevant pump elements can take place.

Before or during a starting phase of the internal combustion engine, the higher pressure pump may temporarily be operated in an unpressurized mode, where the volume control valve 9 may be held closed. After a duration, or after the pressure of fuel being supplied to the higher pressure pump reaches a threshold, the higher pressure pump may exit the unpressurized mode and may enter a pressurized mode where the VCV is open to allow fluid transfer between the pre-supply pump 7 and high-pressure pump 2. It is thereby likewise possible to implement the above-explained measure of at least temporarily unpressurized or load-free operation of the high-pressure pump 2. The reason for this is that no pressure buildup can take place in the pressure chamber (cylinder) of the high-pressure pump 2 when the volume control valve 9 is closed due to the lack of additional fuel being supplied from the pre-supply pump 7. According to the invention, the volume control valve 9 can preferably be electrically actuable. Thus, the volume control valve 9 may be an electrically actuable valve that may be adjusted between a closed first position and an open second position, and/or any positions there-between.

That is, the volume control valve 9 may be opened to introduce fuel into the high-pressure pump 2. In a pressurizing mode, the volume control valve 9 may be held open. However, the high-pressure pump 2 may be operated in an unpressurized mode by maintaining the volume control valve 9 closed. In the unpressurized mode, fuel pressure may not be added to the manifold 4 and nozzles 3.

The invention furthermore envisages that the pre-supply pump 7 can be provided for arrangement within a fuel tank 8. In other examples, the pre-supply pump 7 may be positioned outside the fuel tank 8. The advantages of arrangement within the fuel tank 8 are primarily to be regarded as more compact dimensions and a position of the pre-supply pump 7 in which it is protected from external influences. At the same time, the noise produced thereby can be further minimized by its arrangement within the fuel tank 8.

According to an advantageous development, it is envisaged that, after the starting of the internal combustion engine, pressure within the high-pressure pump 2 may be increased while high-pressure pump 2 is not being operated (e.g., is off) or is being operated in an unpressurized manner. For example, the pre-supply pump 7 may be turned on before putting the high-pressure pump 2 into operation or while the high-pressure pump is being operated in an unpressurized mode. In this way, an initial pressure of the fuel can be produced within the high-pressure pump 2, when the pump 2 is off or being operated in an unpressurized manner. As a result, there is now sufficient time available to meet the requirements regarding lubrication of the bearings of the high-pressure pump by means of the fuel and the necessary filling volume of the high-pressure pump 2. The high-pressure pump 2 can then be put into operation, and the volume control valve 9 may be opened to supply fuel to the higher pressure pump to further pressurize the fuel delivered to the manifold 4 and injection nozzles 3.

In one representation, a common rail injection arrangement comprises a high-pressure pump and at least one injection nozzle (injector). The high-pressure pump is provided for delivering fuel stored in a tank, for example, and at the same time for subjecting it to a pressure above atmospheric pressure. For this purpose, the high-pressure pump can be designed as a gear pump or preferably as a piston machine, for example. In the latter configuration, the necessary injection pressure is produced by means of at least one piston which, for this purpose, is arranged for linear motion within a cylinder. The delivery and pressurization of the fuel, which are thus discontinuous, can be smoothed out by, for example, increasing the number of pistons and corresponding cylinders, which then operate at least partially in opposition.

The heart of the common rail injection arrangement is formed by at least one manifold (common rail). This is arranged between the high-pressure pump and the at least one injection valve and is connected thereto in each case in a manner which allows fluid transfer. As a result, the injection pressure produced by the high-pressure pump can be available at the same level via the manifold at the at least one injection nozzle, preferably simultaneously at a plurality of injection nozzles. The at least one injection nozzle can then be controlled in such a way that the fuel put under pressure by the high-pressure pump is at least partially injected into a combustion chamber of the internal combustion engine via said nozzle(s). The cycle time and volume of the fuel to be injected can be controlled by appropriate control of the at least one injection nozzle.

A feed pump, i.e. a pre-supply pump, is furthermore provided, which is connected to the high-pressure pump in a manner which allows fluid transfer and is not connected to the internal combustion engine or high-pressure pump in a torque-transmitting manner. The pre-supply pump can preferably be arranged between a tank which holds the fuel and the high-pressure pump in order to supply the high-pressure pump with pressurized fuel, even outside the operating phase thereof.

The common rail injection arrangement can advantageously be designed in such a way that a fuel injection pressure built up previously by the high-pressure pump can be maintained at least partially within the common rail injection arrangement, even when the high-pressure pump is stationary.

Turning now to FIGS. 3, 5, and 7, they show example arrangements of a portion of the common rail injection arrangement 1 described above with reference to FIG. 2, including more detailed illustrations of the high-pressure pump 2. In the example of the high-pressure pump 2 shown in FIG. 3, the volume control valve 9 may regulate an amount of fuel supplied to the high-pressure pump 2. In the example of the high-pressure pump 2 shown in FIG. 5, one or more inlet valves that each communicate with a single pressure chamber of the high-pressure pump 2 may regulate an amount of fuel supplied thereto. In the example of the high-pressure pump 2 shown in FIG. 7, the volume control valve 9 and one or more inlet valves may be included to regulate fuel flow through the high-pressure pump 2.

Turning now to FIG. 3, it shows a schematic 300 of a first example of a portion of the of the common rail injection arrangement 1 described above with reference to FIG. 2, including a more detailed illustration of the high-pressure pump 2. In the first example shown in FIG. 3, an amount of fuel supplied to the high-pressure pump 2 by the pre-supply pump 7 may be regulated by the volume control valve 9, as described in detail above with reference to FIG. 2. In a pressurized mode of the high-pressure pump 2, the volume control valve 9 may be held open or at least partially open to permit fuel flow from the lift pump 7 to the high-pressure pump 2. In an unpressurized mode of the high-pressure pump 2, the volume control valve 9 may be held closed, where in the closed position, substantially no fuel may flow through the volume control valve 9 between the lift pump 7 and the high-pressure pump 2.

In this way, during the pressurized mode, the high-pressure pump 2 may add pressure to fuel supplied the pump 2, and therefore may add fuel pressure to fuel included between the high-pressure pump 2 and a fuel rail (e.g., fuel rail 4 described above in FIG. 2). However, in the unpressurized mode, the VCV may be closed and the high-pressure pump 2 may not be supplied with fuel, and thus only fuel already included between the volume control valve 9 and the high-pressure pump 2 when the volume control valve 9 is closed may be pumped towards the fuel rail.

As shown in FIG. 3, the high-pressure pump 2 may comprise a piston pump, which may include multiple pressure chambers or cylinders, each of the pressure chambers including a piston that reciprocates within the pressure chambers to pressurize fuel in the chambers as shown by motion arrows 205. As shown in FIG. 2, the high-pressure pump 2 may include two pump elements 202. However, in other examples, more or less than two pump elements 202 may be included in the high-pressure pump 2. Each of the pump elements 202 includes a pressure chamber or cylinder bore 204, and a piston 206 that reciprocates within the pressure chamber 204 as shown by motion arrows 205 to pressurize fuel included in the pressure chamber 204.

During an intake stroke of each of the pump elements 202, the piston 206 translates within the pressure chamber 204 to increase the volume of the chamber 204. Thus, in the example of FIG. 3, the piston 206 moves downwards during the intake stroke. Fuel may enter the pressure chamber 204 during the intake stroke. For example, when the volume control valve 9 is open, fuel may flow into the chamber 204 during the intake stroke. During a compression stroke of each of the pump elements 202, the piston 206 translates within the pressure chamber 204 to decrease the volume of the chamber 204. Thus, in the example of FIG. 3, the piston 206 moves upwards during the compression stroke. Fuel in the pressure chamber 204 is pressurized during the compression stroke and may exit the pressure chamber 204 via the delivery line 5 and flows towards the fuel rail.

An inlet check valve 210 may be included between the volume control valve 9 and each of the pump elements 202. Thus, the number of inlet check valves may be the same as the number of pump elements 202. Each inlet check valve 210 therefore, may regulate fuel flow between the volume control valve 9, and one of the pump elements 202. The inlet check valve 210 may prevent fuel from flowing backwards towards the volume control valve 9 and lift pump 7. Thus, fuel flow through the check valve 210 is unidirectional, towards one of the pump elements 202 and away from the volume control valve 9. In this way, when the volume control valve 9 is open or at least partially open fuel does not flow out of the pump elements 202 towards the volume control valve 9 and the lift pump 7 due to inclusion of the inlet check valves.

Thus, during the compression stroke of each of the pump elements 202, fuel is not pushed out of the pressure chamber 204 back towards the lift pump 7, and instead exits the pressure chamber 204 via the delivery line 5 due to the inlet check valves.

Similarly, one or more outlet check valves 212 may be included at an outlet of each of the pump elements 202, in the delivery line 5. The outlet check valves 212 may prevent fuel from flowing back into the pump elements 202 from the delivery line 5. Thus, flow through the check valves 212 may be unidirectional, from each of the pump elements 202, towards the fuel rail. Thus, when the VCV 9 is open and supplying fuel to the high-pressure pump 2, fuel flows from the lift pump 7, through the VCV 9, and then through the check valves 210 into the pressure chambers of the pump 2. Fuel then flow from the high-pressure pump 2 to the deliver line 5 towards the fuel rail.

Figure 4:
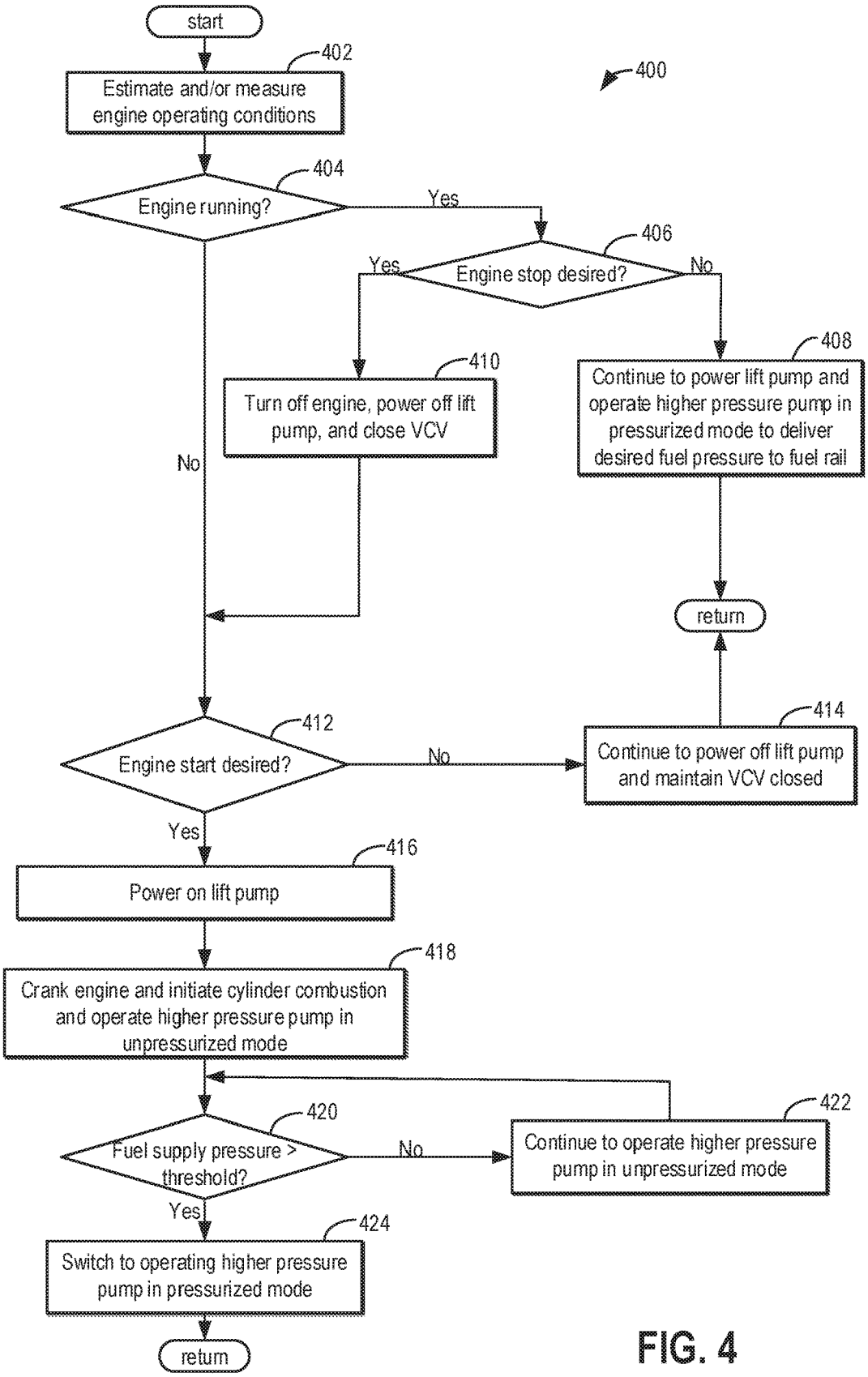
FIG. 4 shows a flow chart of an example method for operating a fuel lift pump of and a volume control valve of the fuel system of FIG. 3.
Figure 5:
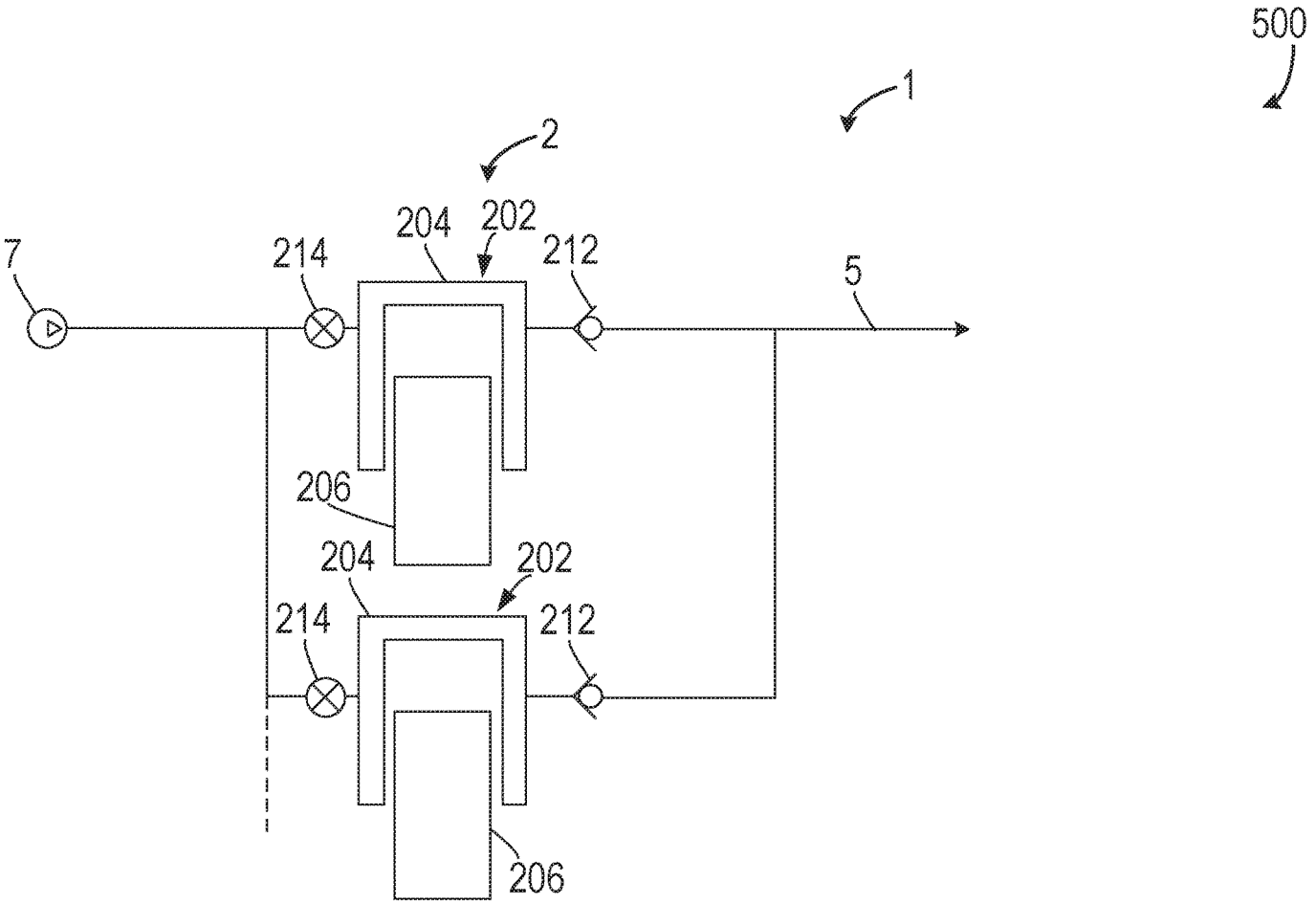
FIG. 5 shows a schematic of a second example of a portion of the fuel system of FIG. 2 including a higher pressure pump.

Continuing to FIG. 4, it shows a first example method 400 for operating a fuel lift pump (e.g., pre-supply pump 7 described above in FIGS. 2 and 3) and high-pressure pump (e.g., high-pressure pump 2 described above in FIGS. 2 and 3) of a direct injection fuel system in a stop-start vehicle. Specifically, the method 400 may be implemented in a fuel system where a single volume control valve (e.g., volume control valve 9 described above in FIGS. 2 and 3) is positioned between the lift pump and the high-pressure pump for regulating fuel flow there-between. Thus, method 400 may be implemented in a fuel system similar to or the same as the example common rail injection arrangement shown in FIG. 3, where a volume control valve and one or more inlet check valves are included between the lift pump and the high-pressure pump.

While an engine (e.g., engine 10 shown in FIG. 1) is running, the engine may drive the higher pressure pump, which pressurizes fuel supplied to a fuel rail (e.g., manifold 4 described in FIG. 2). The higher pressure pump may be a piston pump that comprises one or more cylinders, each cylinder including a reciprocating piston positioned therein for pressurizing the fuel. During a pressurized mode, the volume control valve may remain open to supply fuel from the lift pump to the higher pressure pump. However, during an unpressurized mode, the volume control valve may remain closed, and fuel may not be supplied to the higher pressure pump.

One or more of the lift pump and volume control valve may be controlled by an engine controller (e.g., controller 12 shown in FIG. 1). For example, while the engine is running, the lift pump may be powered on to provide fuel to the higher pressure pump. Further, the volume control valve (VCV) may be opened to introduce fuel into the higher pressure fuel pump. However, when the engine is turned off at an engine stop and the higher pressure pump stops running, the controller may close the VCV. Additionally or alternatively, the controller may power off the lift pump. When restarting the engine from an engine stop, the controller may power on the lift pump, and may operate the higher-pressure fuel pump in an unpressurized mode by maintaining the VCV in a closed position during both the intake and compression strokes of the higher pressure pump for a duration.

Instructions for executing method 400 may be stored in the memory of a controller (e.g., controller 12 described above in FIG. 1). Therefore method 400 may be executed by the controller based on the instructions stored in the memory of the controller and in conjunction with signals received from sensors of the engine system, such as the sensors described above with reference to FIG. 1. The controller may send signals to the lift pump and/or to a power source supplying power to the lift pump, to adjust an amount of power supplied to the lift pump, and therefore an output of the lift pump. Additionally, the controller may send signals to the VCV to adjust a position of the valve.

Method 400 begins at 402 which comprises estimating and/or measuring engine operating conditions. Engine operating conditions may include a fuel rail pressure, a current lift pump speed, an engine speed, a throttle position, an engine load, an operator commanded torque, an intake mass airflow, a fuel injection amount or flow rate, etc.

After estimating and/or measuring engine operating conditions at 402, method 400 may continue to 404 which comprises determining if the engine is running. It may be determined that the engine is not running (e.g., is off) when the engine speed decreases below a threshold or is substantially zero. Thus, when the engine speed is zero, the engine is off and not running. Further, the engine operating state may be determined based on one or more of throttle position, ignition position, intake mass airflow, etc. If the engine is running, then method 400 proceeds from 404 to 406 which comprises determining if an engine stop is desired. The determining if the engine stop is desired may be based on vehicle speed, engine speed, throttle position, driver demanded torque, etc. Thus, an engine stop may be desired when vehicle speed and/or engine speed decrease below a threshold. For example, an engine stop may be desired when the vehicle comes to a stop.

If an engine stop is not desired at 406, method 400 continues from 406 to 408 which comprises continuing to provide power to the lift pump and operating the higher pressure pump in a pressurized mode to deliver a desired fuel pressure to the fuel rail. Thus, the lift pump may continue to be powered to pump fuel from a fuel tank (e.g., tank 8 described above in FIG. 2) to the higher pressure pump. Further the higher pressure pump may be operated in the pressurized mode, where the higher pressure pump adds pressure to fuel received from the lift pump, and propels it towards the fuel rail. The higher pressure pump may be operated in the pressurized mode by maintaining the volume control valve (VCV) open during intake and compression strokes of the pressure chambers of the higher pressure pump to supply the pump with fuel for further pressurization before being delivered to the fuel rail. One or more inlet check valves (e.g., check valves 210 described in FIG. 3) may prevent fuel from flowing out of the higher pressure pump back towards the lift pump during the compression stroke of the higher pressure pump. In this way, fuel pressure is added to the fuel delivery line and fuel rail. Method 400 then returns.

However, if at 406 an engine stop is desired, then method 400 proceeds from 406 to 410 which comprises turning off the engine, powering off the lift pump, and closing the volume control valve (VCV). Method 400 may then continue from 408 to 412 which comprises determining if an engine start is desired. Alternatively, method 400 may continue to 412 from 404, if it is determined at 404 that the engine is not running and is off.

Thus, if it is determined that the engine is off at 404, or if the engine is powered off at 408, method 400 may then proceed to 412 which comprises determining if an engine start is desired. An engine start may be desired for example, when an operator (e.g., operator 130 described above in FIG. 1) depresses an accelerator pedal (e.g., input device 132 described above in FIG. 1). Said another way, if a driver demanded torque increases by more than a threshold, then an engine start may be desired. As such, determining if an engine start is desired may be based on a driver demanded torque, a position of an accelerator pedal, throttle position, etc.

If an engine start is not desired at 412, then method 400 continues from 412 to 414 which comprises continuing to power off the lift pump and maintain the VCV closed in a similar manner to that described above at 410. Powering off the lift pump may also be referred to herein as switching the lift pump to an inactive state. Thus the inactive state may be an operating state of the lift pump where the lift pump is powered off.

However, if an engine start is desired at 412, method 400 may continue from 412 to 416 which comprises powering on the lift pump. Thus, the method 400 at 416 may comprise pumping fuel out from the fuel tank and towards the higher pressure pump to increase a fuel pressure at an inlet of the higher pressure pump. Thus, the method 400 at 416 may comprise pumping fuel out from the fuel tank and towards the higher pressure pump to increase an initial fuel pressure within the higher pressure pump. In some examples, the method 400 at 416 may additionally comprise continuing to maintain the VCV closed. Further, the engine may remain off, and thus the higher pressure pump may remain off at 416. However, in other examples, the engine may be started approximately at the same time as the powering on the lift pump. In yet further examples the engine may be started before powering on the lift pump.

Method 400 may proceed from 416 to 418 in some examples, where the method 400 at 418 comprises cranking the engine and initiating cylinder combustion and operating the higher pressure pump in an unpressurized mode. Thus, the engine may be started at 418. Initiating cylinder combustion may comprise injecting fuel into at least one combustion chamber (e.g., combustion chamber 14 described above in FIG. 1) of the engine. Operating the higher pressure pump in an unpressurized mode may limit and/or prevent the higher pressure pump from adding pressure to fuel included downstream of the higher pressure pump between the higher pressure pump and the fuel injectors. In some examples, a clutch mechanism may be disengaged to decouple the higher pressure pump from the spinning engine. Thus, the engine may run without spinning the higher pressure pump. However, in other examples, the position of the VCV may be adjusted to achieve the unpressurized mode. Specifically, the VCV may be held in the closed position during both the intake and compression strokes of the higher pressure pump so that fuel is not supplied to the higher pressure pump.

It should be appreciated that in some examples method 400 may execute 416 and 418 approximately simultaneously. Thus, in some examples, the lift pump may be powered on when starting the engine. However, in other examples, the lift pump may be powered on prior to starting the engine. In such examples, the method 400 may comprise powering on the lift pump in response to a determination that engine start is desired. Further, in such examples, the method 400 may comprise waiting a threshold duration while powering on the lift pump before starting the engine at 418. In such examples, by powering on the lift pump prior to the engine start, a fuel pressure of fuel included between the lift pump and the higher pressure pump may be increased when the engine starts. In this way, the higher pressure pump may be provided with more pressurized fuel at an engine start.

In yet further examples, the method 400 may execute 416 after 418. Thus, in some examples, the method 400 may comprise starting the engine in response to determining that an engine start is desired, and then powering on the lift pump after the engine is running.

After starting the engine and operating the higher pressure pump in the unpressurized mode, method 400 may then continue from 418 to 420 which comprises determining if the fuel pressure of fuel at an inlet of the higher pressure pump is greater than a threshold. Thus, the method 400 at 420 may comprise determining if the fuel supply pressure of fuel included between the lift pump and higher pressure pump is greater than a threshold. If the pressure of fuel at the inlet of the higher pressure pump is not greater than the threshold, then method 400 may continue from 420 to 422 which comprises continuing to operate the higher pressure pump in the unpressurized mode. However, in other examples, the method 400 at 420 may comprise determining if a duration has passed since the engine start at 418. If the duration has not expired, then method 400 may continue from 420 to 422. After continuing to operate the higher pressure pump in the unpressurized mode at 422, method 400 may return to 420.

In this way, the higher pressure pump may continue to be operated in the unpressurized mode until one or more of the duration since the engine start has expired and/or the fuel pressure at the inlet of the higher pressure pump has reached the threshold. In response to the duration expiring and/or the fuel supply pressure increasing above the threshold at 420, method 400 then continues to 424 which comprises switching to operating the higher pressure pump in the pressurized mode in the same or similar manner to that described at 408. Method 400 then returns.

Turning now to FIG. 5, it shows a schematic 500 of a second example of a portion of the of the common rail injection arrangement 1 described above with reference to FIG. 2, including a more detailed illustration of the high-pressure pump 2. The portion of the common rail injection arrangement 1 shown in FIG. 5 may be the same as that shown above in FIG. 3, except that in the example of FIG. 5, the high-pressure pump 2 may include inlet check valves to regulate fuel flow into each of the pump elements 202 instead of the volume control valve 9 (not shown in FIG. 5). Otherwise, the embodiment of the high-pressure pump 2 and portion of the common rail injection arrangement 1 shown in FIG. 5 may be the same as that shown and described above in FIG. 3. As such, components already introduced and described above in FIG. 3 may not be reintroduced or described again in the description of FIG. 5 herein.

In the second example shown in FIG. 5, an amount of fuel supplied to the high-pressure pump 2 by the pre-supply pump 7 may be regulated by one or more inlet valves 214. Thus, volume control valve 9 (described above with reference to FIGS. 2 and 3) may not be included in the common rail injection arrangement 1. Each of the inlet valves 214 therefore fluidically communicates with one pressure chamber 204, and regulates an amount of fuel flowing between that pressure chamber 204 and the lift pump 7.

In the pressurized mode of the high-pressure pump 2, the inlet valves 214 may be held open during at least a portion of the intake or suction stroke of the pump elements 202 to permit fuel flow into each pressure chamber 204. In some examples, the inlet valves 214 may be held open during the entire intake stroke. Further, in the pressurized mode of the high-pressure pump 2, the inlet valves 214 may be closed during at least a portion of the compression stroke to restrict fuel flow out of the pressure chamber 204 towards the lift pump 7. Thus, when the inlet valves 214 are closed during the compression stroke, fuel in the pump elements 202 may exit each pressure chamber 204 via the delivery line 5 and my flow towards the fuel rail.

In some examples, the inlet valves 214 may be closed during the entire compression stroke. However, in other examples, the inlet valves 214 may be closed for only a portion of the compression stroke. In such examples, where the inlet valves 214 are held open for a portion of the compressions stroke, some fuel in each pressure chamber 204 may exit the pressure chamber 204 and flow back towards the lift pump 7 while the inlet valves 214 are held open. In this way, a pre-supply pressure of fuel included between the lift pump 7 and the high-pressure pump 2 may be increased by holding the inlet valves 214 open during a portion of the compression stroke.

In the unpressurized mode of the high-pressure pump 2, the inlet valves may be held open. Thus, the inlet valves 214 may be held open during both the compression and intake stroked of the pump elements 202. As such, the high-pressure pump 2 may not add pressure to fuel included between the high-pressure pump 2 and the fuel rail during the unpressurized mode. As such, fuel may flow freely between the lift pump 7 and the high-pressure pump 2 through the open intake valves 214.

Inlet valves 214 may be electronically controlled valves. In some examples the inlet valves 214 may be binary valves that may be adjusted to a fully closed position where substantially no fuel flows through the valves 214 or to a fully open position. However, in other examples, the inlet valves 214 may be continuously variable valves and may be adjusted to any position between the fully closed and fully open positions to vary an opening formed by the valve and therefore an amount of fuel flowing there-through. The inlet valves 214 may be adjusted based on signals received from a controller (e.g., controller 12 described above in FIG. 1). The valves 214 may include an actuator for adjusting the position of the valves 214 and therefore an opening formed by the valves 214. The actuator may be an electromagnetic coil. In other examples, the actuator may be an electric motor, or other actuator such a pneumatic, hydraulic, etc.

Figure 6:
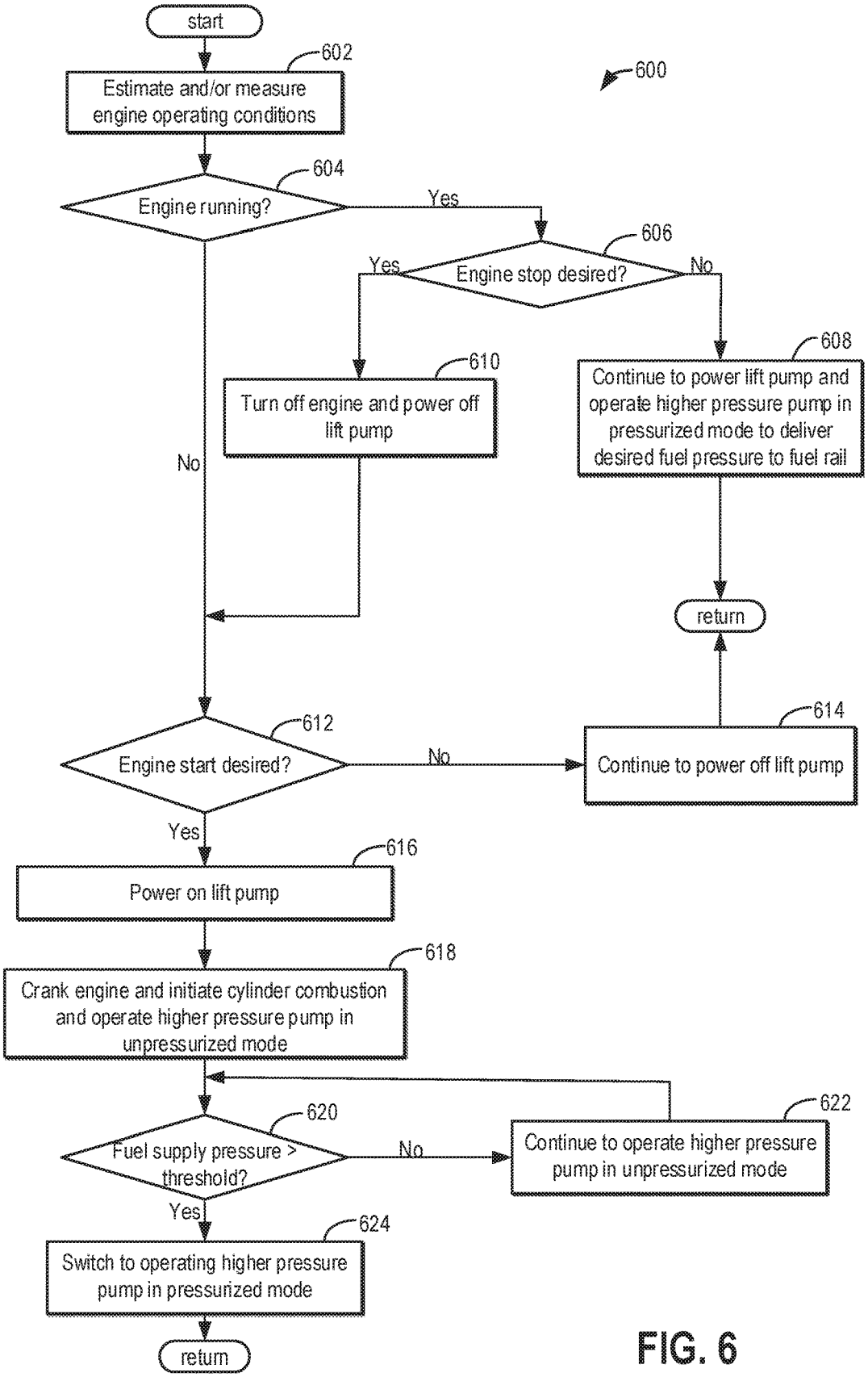
FIG. 6 shows a flow chart of an example method for operating a fuel lift pump and one or more higher pressure pump inlet valves of the fuel system of FIG. 5.
Figure 7:
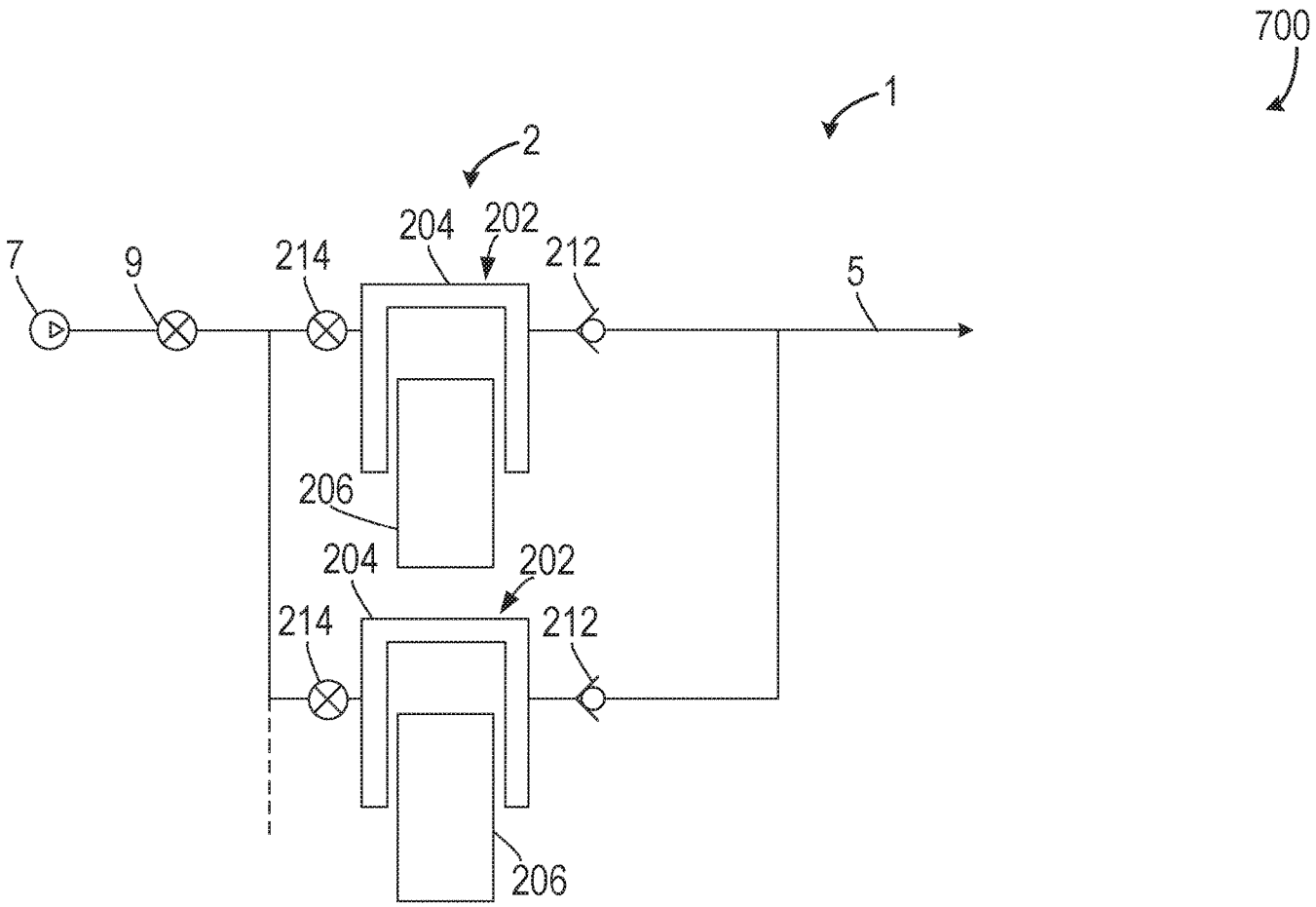
FIG. 7 shows a schematic of a third example of a portion of the fuel system of FIG. 2 including a higher pressure pump.

Continuing to FIG. 6, it shows a second example method 600 for operating a fuel lift pump (e.g., pre-supply pump 7 described above in FIGS. 2, 3, and 5) and high-pressure pump (e.g., high-pressure pump 2 described above in FIGS. 2, 3, and 5) of a direct injection fuel system in a stop-start vehicle. Specifically, the method 600 may be implemented in a fuel system where inlet valves (e.g., inlet valves 214 described in FIG. 5) are positioned between the lift pump and each pressure chamber (e.g., pressure chamber 204 described above in FIGS. 3 and 5) for regulating fuel flow between the lift pump and each pressure chamber of the high-pressure pump. Thus, method 600 may be implemented in a fuel system similar to, or the same as, the example common rail injection arrangement shown in FIG. 5, where a volume control valve is not included and one or more inlet valves are included between the lift pump and the high-pressure pump. The method 600 may be the same as method 400 described above in FIG. 4, except that in the unpressurized mode, the inlet valves may be held open instead of the VCV being held closed as in method 400 of FIG. 4. Otherwise method 600 may be the same as method 400.

The higher pressure pump may be a piston pump that comprises one or more cylinders, each cylinder including a reciprocating piston positioned therein for pressurizing the fuel. Additionally, the fuel system may include a lower pressure lift pump (e.g., pre-supply pump 7 described in FIG. 2) that pumps fuel from a fuel tank (e.g., fuel tank 8 described in FIG. 2) to the higher pressure pump.

Each of the inlet valves may be positioned between the lift pump and a single pressure chamber of the higher pressure pump and thus may provide fluidic communication between the lift pump and a cylinder of the higher pressure pump when open. Thus, each inlet valve may regulate an amount of fuel delivered to one of the cylinders of the higher pressure pump. One or more of the lift pump and inlet valve may be controlled by an engine controller (e.g., controller 12 shown in FIG. 1). For example, while the engine is running, the lift pump may be powered on to provide fuel to the higher pressure pump. Further, higher pressure pump may be operated in a pressurized mode. Specifically, in the pressurized mode, the inlet valve may be opened during an intake stroke of one or more pump elements (e.g., pump elements 202 described above in FIGS. 3 and 5) of the higher pressure fuel pump to introduce fuel into the cylinders of the higher pressure fuel pump. The inlet valve may then be closed during all or a portion of the compression stroke of the pump elements to pressurize the fuel introduced into the cylinders during the intake stroke. However, when the engine is turned off at an engine stop and the higher pressure pump stops running, the controller may maintain the inlet valves open to allow fuel to flow between the higher pressure pump and the lift pump. In other examples, the inlet valves may remain closed during an engine stop. Additionally or alternatively, the controller may power off the lift pump. When restarting the engine from an engine stop, the controller may power on the lift pump, and may operate the higher-pressure fuel pump in an unpressurized mode by maintaining the inlet valves in their open positions during both the intake and compression strokes of the higher pressure pump for a duration.

Instructions for executing method 600 may be stored in the memory of the controller. Therefore method 600 may be executed by the controller based on the instructions stored in the memory of the controller and in conjunction with signals received from sensors of the engine system, such as the sensors described above with reference to FIG. 1. The controller may send signals to the lift pump and/or to a power source supplying power to the lift pump, to adjust an amount of power supplied to the lift pump, and therefore an output of the lift pump. Additionally, the controller may send signals to the inlet valves to adjust positions of the valves.

Method 600 begins at 602 which comprises estimating and/or measuring engine operating conditions in the same or similar manner to that described above in 402 of FIG. 4. After estimating and/or measuring engine operating conditions at 602, method 600 may continue to 604 which comprises determining if the engine is running in the same or similar manner to that described above in 404 of FIG. 4. If the engine is running, then method 600 proceeds from 604 to 606 which comprises determining if an engine stop is desired in the same or similar manner to that described above in 406 of FIG. 4.

If an engine stop is not desired at 606, method 600 continues from 606 to 608 which comprises continuing to provide power to the lift pump and operating the higher pressure pump in a pressurized mode to deliver a desired fuel pressure to the fuel rail. Thus, the lift pump may continue to be powered to pump fuel from a fuel tank (e.g., tank 8 described above in FIG. 2) to the higher pressure pump. Further the higher pressure pump may be operated in the pressurized mode, where the higher pressure pump adds pressure to fuel received from the lift pump, and propels it towards the fuel rail. The higher pressure pump may be operated in the pressurized mode by opening the inlet valves during the intake stroke of the higher pressure pump and then closing the inlet valves during a portion or all of the compressions stoke of the pump elements of the higher pressure pump. Thus, the inlet valves may open to introduce fuel into the pressure chambers of the higher pressure pump, and then the inlet valves may close during a portion or all of the compression stroke to allow the higher pressure pump to pressurize the fuel and propel it towards the fuel rail. In this way, fuel does not flow out of the higher pressure back through the inlet valves and towards the lift pump when the inlet valves are closed during the compression stroke. Method 600 then returns.

However, if at 606 an engine stop is desired, then method 600 proceeds from 606 to 610 which comprises turning off the engine, and powering off the lift pump. In some examples, the method 600 at 610 may additionally comprise opening the inlet valves. Thus, by opening the inlet valves, fuel may flow between the higher pressure pump and the lift pump. However, in other examples, the inlet valves may remain closed at 610. Method 600 may then continue from 608 to 612 which comprises determining if an engine start is desired. Alternatively, method 600 may continue to 612 from 604, if it is determined at 604 that the engine is not running and is off.

Thus, if it is determined that the engine is off at 604, or if the engine is powered off at 608, method 600 may then proceed to 612 which comprises determining if an engine start is desired in the same or similar manner to that described above in 412 of FIG. 4. If an engine start is not desired at 612, then method 600 continues from 612 to 614 which comprises continuing to power off the lift pump in a similar manner to that described above at 610. In some examples the inlet valves may be maintained open at 614. However, in other examples, the inlet valves may be maintained closed at 614.

However, if an engine start is desired at 612, method 600 may continue from 612 to 616 which comprises powering on the lift pump in the same or similar manner to that described above in 416 of FIG. 4. Method 600 may proceed from 616 to 618 in some examples, where the method 600 at 618 comprises cranking the engine and initiating cylinder combustion and operating the higher pressure pump in an unpressurized mode. Thus, the engine may be started at 618. Operating the higher pressure pump in the unpressurized mode may comprise maintaining the inlet valves in their open positions during the intake and compression strokes of the higher pressure pump. In this way, during the compression stroke of the higher pressure pump, fuel introduced to the higher pressure pump during the intake stroke may be expelled from the higher pressure pump back towards the lift pump. In this way, a fuel pressure of fuel upstream of the higher pressure pump between the lift pump and the higher pressure pump (e.g., initial fuel supply pressure) may be increased. Thus, the initial pressure within the higher pressure pump may be increased before, during, and immediately after an engine start by operating the lift pump and/or operating the higher pressure pump in an unpressurized mode.

After starting the engine and operating the higher pressure pump in the unpressurized mode, method 600 may then continue from 618 to 620 which comprises determining if the fuel pressure of fuel at an inlet of the higher pressure pump is greater than a threshold in the same or similar manner to that described above in 420 of FIG. 4. However, in other examples, the method 600 at 620 may comprise determining if a duration has passed since the engine start at 618 in the same or similar manner to that described above in 420 of FIG. 4. If the duration has not expired and/or the fuel supply pressure is not greater than the threshold, then method 600 may continue from 620 to 622 which comprises continuing to operate the higher pressure pump in the unpressurized mode. After continuing to operate the higher pressure pump in the unpressurized mode at 622, method 600 may return to 620.

In this way, the higher pressure pump may continue to be operated in the unpressurized mode until one or more of the duration since the engine start has expired and/or the fuel pressure at the inlet of the higher pressure pump has reached the threshold. In response to the duration expiring and/or the fuel supply pressure increasing above the threshold at 620, method 600 then continues to 624 which comprises switching to operating the higher pressure pump in the pressurized mode in the same or similar manner to that described at 608. Method 600 then returns.

Turning now to FIG. 7, it shows a schematic 700 of a third example of a portion of the of the common rail injection arrangement 1 described above with reference to FIG. 2, including a more detailed illustration of the high-pressure pump 2. The portion of the common rail injection arrangement 1 shown in FIG. 7 may be the same as that shown above in FIGS. 3 and 5, except that in the example of FIG. 5, the high-pressure pump 2 may include both the volume control valve 9 and the inlet check valves 214 to regulate fuel flow between the lift pump 7 and the pump elements 202 of the high-pressure pump 2. Otherwise, the embodiment of the high-pressure pump 2 and portion of the common rail injection arrangement 1 shown in FIG. 7 may be the same as that shown and described above in FIGS. 3 and 5. As such, components already introduced and described above in FIGS. 3 and 5 may not be reintroduced or described again in the description of FIG. 7 herein.

In the third example shown in FIG. 7, an amount of fuel supplied to the high-pressure pump 2 by the pre-supply pump 7 may be regulated by the volume control valve 9 and/or the one or more inlet valves 214. Thus, volume control valve 9 may be included in the common rail injection arrangement 1 between the lift pump 7 and the inlet valves 214. Each of the inlet valves 214 is coupled near an inlet of a pressure chamber 204 and therefore fluidically communicates with the volume control valve 9 and one pressure chamber 204, and regulates an amount of fuel flowing between that pressure chamber 204 and the volume control valve 9. In the pressurized mode of the high-pressure pump 2, the inlet valves 214 may be held open during the intake or suction stroke of the pump elements 202 and the volume control valve 9 may be held open, as described above with reference to FIGS. 3-6, to permit fuel flow into each pressure chamber 204. Further, in the pressurized mode of the high-pressure pump 2, the inlet valves 214 may be closed during at least a portion of the compression stroke to restrict fuel flow out of the pressure chamber 204 towards the lift pump 7. Thus, when the inlet valves 214 are closed during the compression stroke, fuel in the pump elements 202 may exit each pressure chamber 204 via the delivery line 5 and my flow towards the fuel rail. As described above with reference to FIGS. 3 and 4, the volume control valve 9 may be held open during both the intake and compression strokes of the pump elements 202 in the pressurized mode.

In some examples, the inlet valves 214 may be closed during the entire compression stroke. However, in other examples, the inlet valves 214 may be closed for only a portion of the compression stroke. In such examples, where the inlet valves 214 are held open for a portion of the compressions stroke, some fuel in each pressure chamber 204 may exit the pressure chamber 204 and flow back towards the lift pump 7 while the inlet valves 214 are held open. In this way, a pre-supply pressure of fuel included between the lift pump 7 and the high-pressure pump 2 may be increased by holding the inlet valves 214 open during a portion of the compression stroke.

In the unpressurized mode of the high-pressure pump 2, the inlet valves 214 may be held open and the volume control valve 9 may be held closed as described above with reference to FIGS. 3-6. As such, when the volume control valve 9 is closed, no additionally fuel may be supplied to the high-pressure pump 2. Thus, the high-pressure pump 2 may only add pressure to fuel included between the high-pressure pump 2 the volume control valve 9 when the volume control valve 9 is closed. However, since the inlet valves 214 may remain open, the high-pressure pump 2 may not add pressure to fuel included between the pump 2 and the fuel rail, as fuel may slosh back and forth between the high-pressure pump 2 and the volume control valve 9 through the open inlet valves 214.

Figure 8:
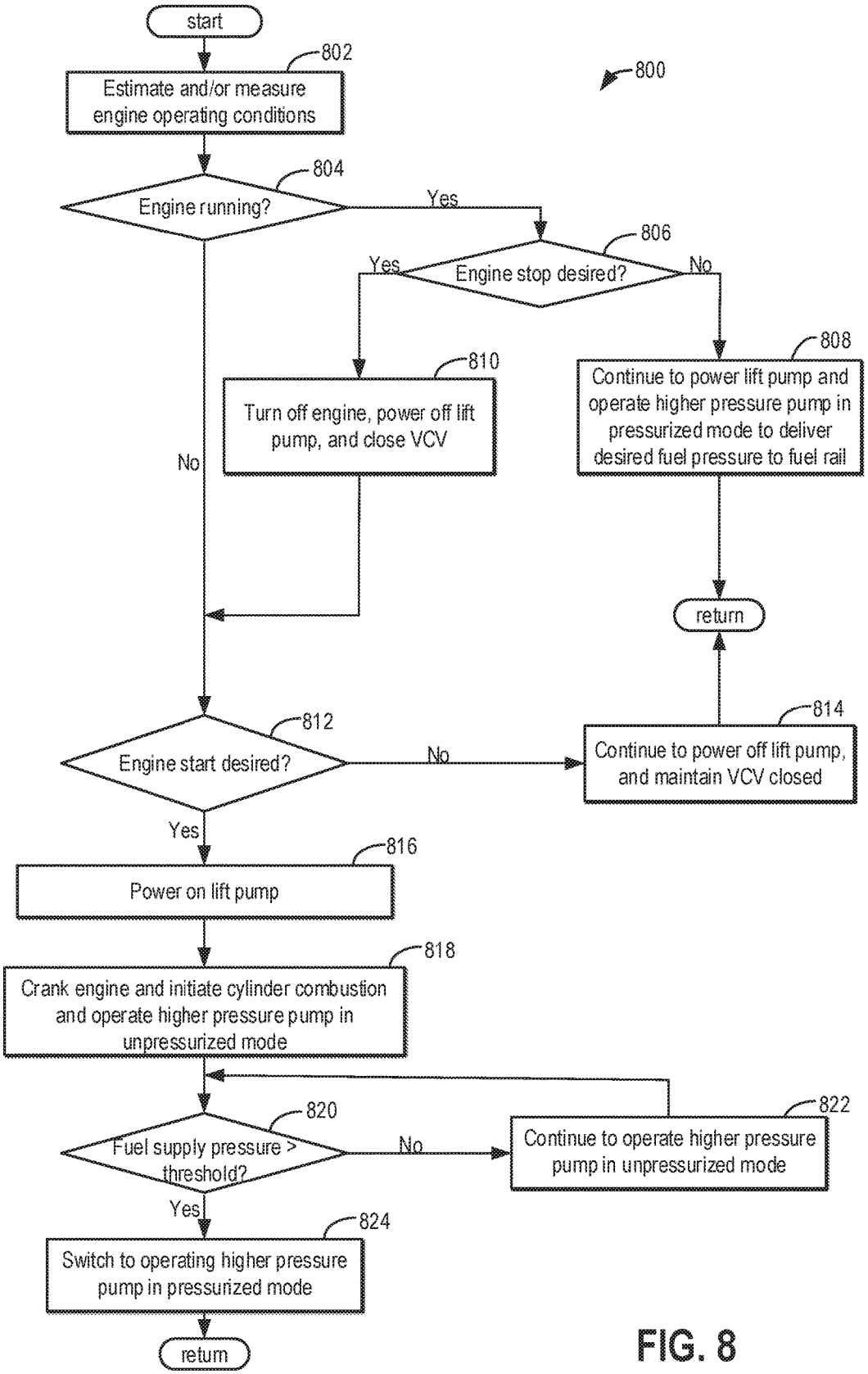
FIG. 8 shows a flow chart of an example method for operating a fuel lift pump, volume control valve, and one or more higher pressure pump inlet valves of the fuel system of FIG. 7.

Continuing to FIG. 8, it shows a third example method 800 for operating a fuel lift pump (e.g., pre-supply pump 7 described above in FIGS. 2, 3, 5, and 7) and high-pressure pump (e.g., high-pressure pump 2 described above in FIGS. 2, 3, 5, and 7) of a direct injection fuel system in a stop-start vehicle. Specifically, the method 800 may be implemented in a fuel system where both a single volume control valve (e.g., volume control valve 9 described above in FIGS. 2 and 3) is positioned between the lift pump and the high-pressure pump, and one or more inlet valves (e.g., inlet valves 214 described in FIG. 5) are positioned between the lift pump and each pressure chamber (e.g., pressure chamber 204 described above in FIGS. 3 and 5) of the high-pressure pump for regulating fuel flow between the lift pump and each pressure chamber. Thus, method 800 may be implemented in a fuel system similar to, or the same as, the example common rail injection arrangement shown in FIG. 7, where both a volume control valve and one or more inlet valves are included between the lift pump and the high-pressure pump.

One or more of the lift pump, volume control valve (VCV), and inlet valves may be controlled by an engine controller (e.g., controller 12 shown in FIG. 1). For example, while the engine is running, the lift pump may be powered on to provide fuel to the higher pressure pump. Further, the VCV may be held open to supply fuel to the higher pressure pump, and the inlet valves may be opened during an intake stroke of the pump elements to introduce fuel into the pressure chambers of the higher pressure fuel pump. The inlet valves may then be closed during all or a portion of the compression stroke of the pump elements to ensure that the fuel introduced into the cylinder during the intake stroke is pressurized and routed to the fuel rail. However, when the engine is turned off at an engine stop and the higher pressure pump stops running, the controller may close the VCV and may maintain the inlet valves open. However, in other examples, the inlet valves may remain closed during an engine stop. Additionally or alternatively, the controller may power off the lift pump. When restarting the engine from an engine stop, the controller may power on the lift pump, and may operate the higher-pressure fuel pump in an unpressurized mode by maintaining the inlet valves open and the VCV closed during both the intake and compression strokes of the higher pressure pump for a duration.

Instructions for executing method 800 may be stored in the memory of the controller. Therefore method 800 may be executed by the controller based on the instructions stored in the memory of the controller and in conjunction with signals received from sensors of the engine system, such as the sensors described above with reference to FIG. 1. The controller may send signals to the lift pump and/or to a power source supplying power to the lift pump, to adjust an amount of power supplied to the lift pump, and therefore an output of the lift pump. Additionally, the controller may send signals to the inlet valve to adjust a position of the valve.

Method 800 begins at 802 which comprises estimating and/or measuring engine operating conditions in the same or similar manner to that described above in 402 of FIG. 4. After estimating and/or measuring engine operating conditions at 802, method 800 may continue to 804 which comprises determining if the engine is running in the same or similar manner to that described above in 404 of FIG. 4. If the engine is running, then method 800 proceeds from 804 to 806 which comprises determining if an engine stop is desired in the same or similar manner to that described above in 406 of FIG. 4. If an engine stop is not desired at 806, method 800 continues from 806 to 808 which comprises continuing to provide power to the lift pump and operating the higher pressure pump in a pressurized mode to deliver a desired fuel pressure to the fuel rail. Thus, the lift pump may continue to be powered to pump fuel from a fuel tank (e.g., tank 8 described above in FIG. 2) to the higher pressure pump. Further the higher pressure pump may be operated in the pressurized mode, where the higher pressure pump adds pressure to fuel received from the lift pump, and propels it towards the fuel rail. The higher pressure pump may be operated in the pressurized mode by maintaining the VCV open during both intake and compression strokes of the higher pressure pump, and opening the inlet valves during the intake stroke and then closing the inlet valve during a portion or all of the compression stoke of the higher pressure pump. Thus, the inlet valves may open to introduce fuel into the higher pressure pump during the intake stroke, and then may close during a portion or all of the compression stroke to allow the higher pressure pump pressurize the fuel, so that fuel does not flow out of the higher pressure back through the inlet valves and towards the lift pump. Method 800 then returns.

However, if at 806 an engine stop is desired, then method 800 proceeds from 806 to 810 which comprises turning off the engine, powering off the lift pump, and closing the VCV. In some examples, the method 800 at 810 may additionally comprise opening the inlet valves. However, in other examples, the method 800 at 810 may comprise closing the inlet valves. Method 800 may then continue from 808 to 812 which comprises determining if an engine start is desired. Alternatively, method 800 may continue to 812 from 804, if it is determined at 804 that the engine is not running and is off.

Thus, if it is determined that the engine is off at 804, or if the engine is powered off at 808, method 800 may then proceed to 812 which comprises determining if an engine start is desired in the same or similar manner to that described above in 412 of FIG. 4. If an engine start is not desired at 812, then method 800 continues from 812 to 814 which comprises continuing to power off the lift pump and maintaining the VCV closed in a similar manner to that described above at 810. In some examples, the method 800 at 814 may additionally comprise maintaining the inlet valves open. However in other examples, the inlet valves may be held in a closed position at 814. However, if an engine start is desired at 812, method 800 may continue from 812 to 816 which comprises powering on the lift pump in the same or similar manner to that described above in 416 of FIG. 4.

Method 800 may proceed from 816 to 818 in some examples, where the method 800 at 818 comprises cranking the engine and initiating cylinder combustion and operating the higher pressure pump in an unpressurized mode. Thus, the engine may be started at 818. Operating the higher pressure pump in an unpressurized mode may limit and/or prevent the higher pressure pump from adding pressure to fuel included downstream of the higher pressure pump between the higher pressure pump and the fuel injectors. In some examples, a clutch mechanism may be disengaged to decouple the higher pressure pump from the spinning engine. Thus, the engine may run without spinning the higher pressure pump. However, in other examples, operating the higher pressure pump in the unpressurized mode may comprise closing the VCV, and opening the inlet valves. Specifically, the inlet valves may be adjusted to a more open position at 818, and may be held in an open position during both the intake and compression strokes of the higher pressure pump.

After starting the engine and operating the higher pressure pump in the unpressurized mode, method 800 may then continue from 818 to 820 which comprises determining if the fuel pressure of fuel at an inlet of the higher pressure pump is greater than a threshold in the same or similar manner to that described above in 420 of FIG. 4. However, in other examples, the method 800 at 820 may comprise determining if a duration has passed since the engine start at 818 in the same or similar manner to that described above in 420 of FIG. 4. If the duration has not expired and/or the fuel supply pressure is not greater than the threshold, then method 800 may continue from 820 to 822 which comprises continuing to operate the higher pressure pump in the unpressurized mode. After continuing to operate the higher pressure pump in the unpressurized mode, method 800 may return to 820 from 822.

In this way, the higher pressure pump may continue to be operated in the unpressurized mode until one or more of the duration since the engine start has expired and/or the fuel pressure at the inlet of the higher pressure pump has reached the threshold. In response to the duration expiring and/or the fuel pressure at the inlet of the higher pressure pump increasing above the threshold at 820, method 800 then continues to 824 which comprises switching to operating the higher pressure pump in the pressurized mode in the same or similar manner to that described at 808. Method 800 then returns.

In this way, when exiting an engine stop and initiating a start phase of a stop-start engine, a lift pump may be powered on, and a higher pressure pump may be operated in an unpressurized mode to increase fuel pressure upstream of the higher pressure pump. In a first example where a volume control valve is included between the lift pump and higher pressure pump for regulating fuel flow to the higher pressure pump, the valve may be closed in the unpressurized mode to discontinue fuel supply to the higher pressure pump. In another example, one or more inlet valves may be included in the higher pressure pump to regulate fuel flow to each pressure chamber of the higher pressure pump. In such examples, the inlet valves may be opened during the unpressurized mode to permit fuel to flow from the higher pressure pump back towards the lift pump. In yet further examples both a volume control valve and one or more inlet valves may be included and the volume control valve may be closed while the inlet valves may be opened in the unpressurized mode. Closing the volume control valve and/or opening the inlet valves may increase the fuel supply pressure of fuel being supplied to the higher pressure pump. Thus, the pressure of fuel included between the lift pump and the higher pressure pump may be increased such that the pressure of fuel received by the higher pressure pump is increased. Once the fuel pressure of fuel at an inlet of the higher pressure pump has reached a threshold, the higher pressure pump may be operate in a pressurized mode, and may add pressure to fuel being pumped towards a fuel rail and fuel injectors. In the pressurized mode, the volume control valve may be opened and/or the inlet valves may be closed during a portion or all of the compression stroke of the higher pressure pump to further pressurize fuel introduced to the higher pressure pump, and deliver it to a fuel rail.

In one representation, a method for operating a common rail injection arrangement, which is provided for an internal combustion engine having a stop-start system and which comprises a pre-supply pump, connected to a high-pressure pump in a manner which allows fluid transfer, and a manifold, connected to the high-pressure pump in a manner which allows fluid transfer, as well as at least one injection nozzle, connected to the manifold in a manner which allows fluid transfer, wherein the pre-supply pump is kept active when the internal combustion engine is in operation may comprise: initiating a stop phase by putting the running internal combustion engine and the high-pressure pump out of operation, wherein the pre-supply pump may be switched to the inactive state, initiating a starting phase for the out-of-operation internal combustion engine, wherein the high-pressure pump may be operated at least temporarily in an unpressurized state before or during the starting phase of the internal combustion engine, while the pre-supply pump is switched to the active state and delivers fuel to the high-pressure pump and builds up pre-supply pressure, operating the high-pressure pump to maintain and/or increase the pressure within the common rail injection arrangement, when a pre-supply pressure increases above a threshold, and starting the internal combustion engine by cranking the engine and injecting fuel into a combustion chamber of the internal combustion engine with the aid of the pressure provided within the common rail injection arrangement. In some examples of the above method, the common rail injection arrangement may be at least partially closed by at least one shutoff valve to maintain the pressure within said arrangement. In any one or combination of the above methods, the common rail injection arrangement may comprise a volume control valve, the volume control valve connected to the high-pressure pump in a manner which allows fluid transfer and may be closed in conjunction with the stop phase of the internal combustion engine. In any one or combination of the above methods, the operating the high-pressure pump in the unpressurized state may comprise closing the volume control valve. Any one or combination of the above methods may further comprise, switching on the pre-supply pump before starting the engine and putting the high-pressure pump into operation to increase an initial pressure within the high-pressure pump. Any one or combination of the above methods may further comprise, switching on the pre-supply pump while operating the high-pressure pump in the unpressurized manner when starting the internal combustion engine, to increase an initial pressure within the high-pressure pump. In any one or combination of the above methods, the pre-supply pump may be positioned within a fuel tank.

In another representation a system for a common rail injection arrangement of a stop-start engine may comprise: a high-pressure fuel pump, a pre-supply pump, connected to a high-pressure fuel pump in a manner which allows fluid transfer, wherein the pre-supply pump is kept active when the internal combustion engine is in operation, a manifold, connected to the high-pressure pump in a manner which allows fluid transfer, at least one injection nozzle, connected to the manifold in a manner which allows fluid transfer, and a controller with computer readable instructions stored in non-transitory memory for: initiating a stop phase by putting the running internal combustion engine and the high-pressure pump out of operation, wherein the pre-supply pump is also switched to the inactive state, maintaining, within the common rail injection arrangement, a pressure built up by the high-pressure pump during the operation of the internal combustion engine, wherein the pre-supply pump is simultaneously kept inactive, initiating a starting phase for the out-of-operation internal combustion engine, wherein the pre-supply pump is switched to an active state, starting of the internal combustion engine by cranking the latter and at least partial injection of fuel into a combustion chamber of the internal combustion engine with the aid of the pressure maintained within the common rail injection arrangement, wherein the high-pressure pump is operated at least temporarily in an unpressurized state during the starting, and switching the high-pressure pump into a pressurized state to maintain and/or increase the pressure within the common rail injection arrangement, in response to a pre-supply pressure increasing above a threshold to continue supplying the running internal combustion engine with fuel. The controller of above system may further include instructions for maintaining the pre-supply pump in the inactive state during the initiating of the starting phase and powering on the pre-supply pump after starting the engine. In any one or combination of the above systems, the controller may further include instructions for powering on the pre-supply pump during the starting phase.

In yet a further representation, a method for a stop-start engine may comprise during an engine stop: powering off a lift pump, and in response to determining an engine start is desired: powering on the lift pump, initiating cylinder combustion, and operating a higher pressure pump (HPP) in an unpressurized mode, and switching the HPP to a pressurized mode in response to fuel pressure upstream of the HPP reaching a threshold. In some examples, the above method may further comprise during the engine stop, closing a volume control valve positioned between the HPP and the lift pump to stop supplying fuel the HPP, where in the closed position of the volume control valve, substantially no fuel flows flow there-through. Any one or combination of the above methods may further comprise during the engine stop, opening an inlet valve positioned between the lift pump and a single pressure chamber of the HPP for regulating fuel flow there-between to permit fuel flow between the pressure chamber and the lift pump. In any one or combination of the above methods, the operating the HPP in the unpressurized mode comprises maintaining a volume control valve positioned between the lift pump and the HPP in a closed position during both intake and compression strokes of the HPP. In any one or combination of the above methods, the operating the HPP in the unpressurized mode may comprise maintaining an inlet valve positioned between the lift pump and a single pressure chamber of the HPP in an open position to permit fuel flow between the pressure chamber and the lift pump and add pressure to fuel included upstream of the pressure chamber, between the pressure chamber and the lift pump. In any one or combination of the above methods, the switching the HPP to the pressurized mode may comprise opening a volume control valve positioned between the lift pump and the HPP during both intake and compression strokes of the HPP. In any one or combination of the above methods, the switching the HPP to the pressurized mode may comprise opening an inlet valve positioned between the lift pump and a single pressure chamber of the HPP during an intake stroke of a piston of the pressure chamber to supply fuel to the pressure chamber, and closing the inlet valve during a portion or all of a compression stroke of the piston of the pressure chamber to add pressure to fuel included downstream of the HPP, between the HPP and one or more fuel injectors. In any one or combination of the above methods, the powering on the lift pump may occur before initiating cylinder combustion, and wherein the method further comprises after powering on the lift pump, waiting a duration before initiating cylinder combustion. In any one or combination of the above methods, the powering on the lift pump and the initiating cylinder combustion may occur approximately simultaneously. In any one or combination of the above methods, in the unpressurized mode, the higher pressure pump may not add pressure to fuel included downstream of the higher pressure pump between the higher pressure pump and a fuel rail. In any one or combination of the above methods the operating the HPP in the unpressurized mode may comprise not transmitting torque from the engine to the HPP, and wherein the operating the HPP in the pressurized mode may comprise transmitting torque from the engine to the HPP to spin the HPP.

In this way, a technical effect of reducing energy consumption during a stop phase of a stop-start vehicle is achieved by powering off a lift pump during the stop phase.

Fuel pressure in a fuel rail and fuel injectors may be maintained during the stop phase by closing a valve positioned between the lift pump and a higher pressure pump. In this way, energy consumption may be reduced without sacrificing fuel rail pressure and/or delaying fuel injection at an engine start. Another technical effect of reducing noise production is achieved by powering off the lift pump during the stop phase.

Another technical effect of reducing degradation to the higher pressure fuel pump is achieved by operating the higher pressure fuel pump in an unpressurized manner during an engine start. Operating the higher pressure pump in the unpressurized manner eliminates the otherwise necessary uninterrupted supply of a lubricant film by the permanently applied preliminary fuel pressure. It is also advantageous that, in this way, the pre-supply pump can be switched off in the stop phase but can also be kept partially inactive, even when the high-pressure pump is starting up in an unpressurized manner, thus enabling energy consumption and the noise which would otherwise be perceptible in stop phases to be minimized.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating a common rail injection arrangement, which is provided for an internal combustion engine having a stop-start system and which comprises a pre-supply pump connected to a high-pressure pump in a manner which allows fluid transfer, a volume control valve located upstream of the high-pressure pump and downstream of the pre-supply pump which controls fluid transfer therethrough, and a manifold connected to the high-pressure pump in a manner which allows fluid transfer, as well as at least one injection nozzle connected to the manifold in a manner which allows fluid transfer, wherein the pre-supply pump is kept active when the internal combustion engine is in operation, the method comprising:

initiating a stop phase by shutting down the running internal combustion engine and putting the high-pressure pump out of operation, wherein the pre-supply pump is switched to an inactive state;

initiating a starting phase for the out-of-operation internal combustion engine, wherein the high-pressure pump is operated at least temporarily in an unpressurized state while the volume control valve substantially prevents fluid flow therethrough before or during the starting phase of the internal combustion engine, while the pre-supply pump is switched to an active state and delivers fuel to the high-pressure pump and builds up pre-supply pressure;

operating the high-pressure pump to increase pressure within the common rail injection arrangement, in response to the pre-supply pressure increasing above a threshold; and starting the internal combustion engine by cranking the engine and injecting fuel into a combustion chamber of the internal combustion engine with the aid of the pressure provided within the common rail injection arrangement.

2. The method of claim 1, wherein the common rail injection arrangement is at least partially closed by at least one shutoff valve.

3. The method of claim 1, wherein the volume control valve is connected to the high-pressure pump in a manner which allows fluid transfer and is closed in conjunction with the stop phase of the internal combustion engine.

4. The method of claim 3, wherein operating the high-pressure pump to increase pressure within the common rail injection arrangement, in response to the pre-supply pressure increasing above the threshold further comprises opening the volume control valve to enable fluid flow therethrough.

5. The method of claim 1, further comprising switching on the pre-supply pump before starting the engine and putting the high-pressure pump into operation to increase an initial pressure within the high-pressure pump.

6. The method of claim 1, further comprising switching on the pre-supply pump while operating the high-pressure pump in the unpressurized state when starting the internal combustion engine to increase an initial pressure within the high-pressure pump.

7. A system for a common rail injection arrangement of a stop-start engine, the system comprising:

a high-pressure fuel pump;

a pre-supply pump connected to the high-pressure fuel pump in a manner which allows fluid transfer, wherein the pre-supply pump is kept active when an internal combustion engine is in operation;

a volume control valve which controls fluid transfer therethrough;

a manifold connected to the high-pressure fuel pump in a manner which allows fluid transfer;

at least one injection nozzle connected to the manifold in a manner which allows fluid transfer; and a controller with computer readable instructions stored in non-transitory memory for:

initiating a stop phase by putting the running internal combustion engine and the high-pressure fuel pump out of operation, wherein the pre-supply pump is also switched to an inactive state and the volume control valve is moved to a closed position which substantially prevents fluid flow therethrough;

maintaining, within the common rail injection arrangement, a pressure built up by the high-pressure fuel pump during the operation of the internal combustion engine, wherein the pre-supply pump is kept inactive during the maintaining;

initiating a starting phase for the out-of-operation internal combustion engine, wherein the pre-supply pump is switched to an active state;

starting the internal combustion engine by cranking the latter and at least partial injection of fuel into a combustion chamber of the internal combustion engine with the aid of the pressure maintained within the common rail injection arrangement, wherein the high-pressure fuel pump is operated at least temporarily in an unpressurized state during the starting; and switching the high-pressure fuel pump into a pressurized state to maintain or increase the pressure within the common rail injection arrangement and opening the volume control valve in response to a pre-supply pressure increasing above a threshold to continue supplying the running internal combustion engine with fuel.

8. The system of claim 7, wherein the controller further includes instructions for powering on the pre-supply pump in the active state.

9. A method for a stop-start engine comprising:

during an engine stop:

powering off a lift pump; and closing a volume control valve; and in response to receiving a desired engine start:

powering on the lift pump;

initiating cylinder combustion; and operating a higher pressure pump (HPP) in a mode with an inlet valve between the lift pump and the HPP open; and, after combustion is initiated, switching the HPP to a pressurized mode in response to fuel pressure upstream of the HPP reaching a threshold, and otherwise maintaining the inlet valve open.

10. The method of claim 9, further comprising, during the engine stop, closing the volume control valve positioned between the HPP and the lift pump to stop supplying fuel to the HPP, where, in the closed position of the volume control valve, substantially no fuel flows therethrough.

11. The method of claim 9, further comprising, during the engine stop, opening the inlet valve positioned between the lift pump and a single pressure chamber of the HPP for regulating fuel flow therebetween to permit fuel flow between the pressure chamber and the lift pump.

12. The method of claim 9, further comprising, during the engine stop, closing the inlet valve positioned between the lift pump and a single pressure chamber of the HPP for regulating fuel flow therebetween to restrict fuel flow between the pressure chamber and the lift pump.

13. The method of claim 9, where the operating the HPP in the mode comprises maintaining the volume control valve positioned between the lift pump and the HPP in a closed position during both intake and compression strokes of the HPP.

14. The method of claim 9, where the operating the HPP in the mode comprises maintaining the inlet valve positioned between the lift pump and a single pressure chamber of the HPP to permit fuel flow between the pressure chamber of the HPP and the lift pump and add pressure to fuel included upstream of the pressure chamber, between the pressure chamber and the lift pump.

15. The method of claim 9, wherein the switching the HPP to the pressurized mode comprises opening the volume control valve positioned between the lift pump and the HPP during both intake and compression strokes of the HPP.

16. The method of claim 9, wherein the switching the HPP to the pressurized mode comprises opening the inlet valve positioned between the lift pump and a single pressure chamber of the HPP during an intake stroke of a piston of the pressure chamber to supply fuel to the pressure chamber, and closing the inlet valve during a portion or all of a compression stroke of the piston of the pressure chamber to add pressure to fuel included downstream of the HPP, between the HPP and one or more fuel injectors.

17. The method of claim 9, wherein the powering on the lift pump occurs before initiating cylinder combustion, and wherein the method further comprises, after powering on the lift pump, waiting a duration before initiating cylinder combustion.

18. The method of claim 9, wherein the powering on the lift pump and the initiating cylinder combustion occur approximately simultaneously.

19. The method of claim 9, where in the mode, the HPP does not add pressure to fuel included downstream of the HPP between the HPP and a fuel rail.

20. The method of claim 9, wherein the operating the HPP in the mode comprises not transmitting torque from the engine to the HPP, and wherein the operating the HPP in the pressurized mode comprises transmitting torque from the engine to the HPP to spin the HPP.

* * * * *